US010791857B2

(12) United States Patent
Bergida et al.

(10) Patent No.: US 10,791,857 B2
(45) **Date of Patent: *Oct. 6, 2020**

(54) DRINKING VESSEL HAVING ENGAGEMENT FEATURES AND CAMOUFLAGING NON-ENGAGEMENT ELEMENTS IN INTAGLIO

(71) Applicant: Celebrate Everywhere, LLC, Front Royal, VA (US)

(72) Inventors: John R. Bergida, Front Royal, VA (US); Marvin M. Bergida, Front Royal, VA (US); Justin D. Eakes, Blue Springs, MO (US)

(73) Assignee: CELEBRATE EVERYWHERE, LLC, Front Royal, VA (US)

( * ) Notice: Subject to any disclaimer, the term of this patent is extended or adjusted under 35 U.S.C. 154(b) by 234 days.

This patent is subject to a terminal disclaimer.

(21) Appl. No.: 15/818,935

(22) Filed: Nov. 21, 2017

(65) Prior Publication Data

US 2018/0132638 A1 May 17, 2018

Related U.S. Application Data

(63) Continuation-in-part of application No. 14/029,020, filed on Sep. 17, 2013, now Pat. No. 9,821,930, which is a continuation-in-part of application No. 13/240,194, filed on Sep. 22, 2011, now abandoned.

(60) Provisional application No. 61/703,637, filed on Sep. 20, 2012.

(51) Int. Cl.
*A47G 19/22* (2006.01)
*B65D 43/02* (2006.01)

(52) U.S. Cl.
CPC ..... *A47G 19/2205* (2013.01); *B65D 43/0225* (2013.01); *B65D 2203/00* (2013.01)

(58) Field of Classification Search
CPC ..... B65D 43/0225; A47G 19/2205
USPC ..... 220/730
See application file for complete search history.

(56) References Cited

U.S. PATENT DOCUMENTS

| | | | |
|---|---|---|---|
| D22,497 | S | 6/1893 | Rauchfuss |
| 640,860 | A | 1/1900 | Baum, Jr. |
| 728,981 | A | 5/1903 | Rose |
| D38,969 | S | 12/1907 | Buckey |
| D41,341 | S | 5/1911 | Gredelue |

(Continued)

FOREIGN PATENT DOCUMENTS

| | | | |
|---|---|---|---|
| DE | 4109886 | A1 | 10/1992 |
| DE | 10122951 | A1 | 1/2003 |

(Continued)

*Primary Examiner* — Anthony D Stashick
*Assistant Examiner* — Lauren Kmet
(74) *Attorney, Agent, or Firm* — Buchanan Ingersoll & Rooney PC

(57) ABSTRACT

The utilitarian function of the engagement features on a lidded vessel is at least partially camouflaged so that the engagement features' utilitarian function is less apparent to the consumer after the lid is removed. The lidded vessel may be, for example, a lidded drinking glass—such as a lidded wine glass, beer glass, whiskey tumbler or soda glass—that is sold pre-filled and sealed with the wine, beer, whiskey or soda already inside. The camouflaging may be accomplished using one or more camouflaging techniques, some or all of them involving the presence of non-engagement elements.

26 Claims, 20 Drawing Sheets

(56) References Cited

U.S. PATENT DOCUMENTS

| | | | |
|---|---|---|---|
| D42,348 | S | 3/1912 | Bottome |
| D42,994 | S | 9/1912 | Gunthel |
| D43,568 | S | 2/1913 | Heinzelman |
| D43,569 | S | 2/1913 | Heinzelman |
| D46,806 | S | 12/1914 | Krall |
| D47,451 | S | 6/1915 | Bottome |
| D48,081 | S | 11/1915 | Provance |
| D48,706 | S | 3/1916 | Bottome |
| 1,243,033 | A | 10/1917 | Beatty |
| D52,301 | S | 8/1918 | Bottome |
| 1,351,496 | A | 8/1920 | Horace |
| D65,041 | S | 7/1924 | Adams |
| D75,836 | S | 7/1928 | Giese |
| D95,593 | S | 5/1935 | Kramer |
| 2,057,972 | A | 10/1936 | Edward |
| D120,226 | S | 4/1940 | Lundy |
| D121,573 | S | 7/1940 | Lundy |
| D156,083 | S | 11/1949 | Ferree |
| D163,564 | S | 6/1951 | Brown et al. |
| 2,700,249 | A | 1/1955 | Miller |
| 2,766,796 | A | 10/1956 | Tupper |
| 2,996,208 | A | 8/1961 | Schroeder |
| 3,089,605 | A | 5/1963 | Buonauro |
| D195,981 | S | 8/1963 | Lorenzen |
| 3,140,007 | A | 7/1964 | Nettleship |
| 3,349,950 | A | 10/1967 | Wanderer |
| 3,369,687 | A | 2/1968 | Walls |
| 3,402,844 | A | 9/1968 | Chin |
| 3,526,335 | A | 9/1970 | Swett |
| 4,101,044 | A | 7/1978 | Paquette et al. |
| D254,831 | S | 4/1980 | Smith |
| 4,834,251 | A | 5/1989 | Yu |
| 4,948,000 | A | 8/1990 | Grabenkort |
| D333,591 | S | 3/1993 | Gradecki et al. |
| D359,197 | S | 6/1995 | Hernandez et al. |
| D373,706 | S | 9/1996 | Gregg |
| 5,570,797 | A | 11/1996 | Yeh |
| D377,737 | S | 2/1997 | Kristnik |
| 5,662,233 | A | 9/1997 | Reid |
| 5,975,322 | A | 11/1999 | Reid |
| 6,006,930 | A | 12/1999 | Dreyer et al. |
| 6,164,473 | A | 12/2000 | Waldrip |
| 6,398,050 | B1 | 6/2002 | Allora |
| 6,662,959 | B1 | 12/2003 | Westerhold |
| 6,905,038 | B2 | 6/2005 | Lopez |
| 7,467,726 | B1 | 12/2008 | Izraelev |
| 7,770,748 | B2 | 8/2010 | Elliott |
| 7,950,545 | B1 | 5/2011 | Roberts |
| 7,997,434 | B2 | 8/2011 | Benetti |
| 8,328,014 | B2 | 12/2012 | Saunders et al. |
| 9,821,930 | B1 * | 11/2017 | Bergida ..... B65D 41/0435 |
| 2003/0178427 | A1 | 9/2003 | Chomik |
| 2004/0118804 | A1 | 6/2004 | Westerhold |
| 2004/0247749 | A1 | 12/2004 | Lambert et al. |
| 2005/0045632 | A1 | 3/2005 | Lopez |
| 2005/0092760 | A1 | 5/2005 | Westerhold |
| 2005/0139570 | A1 | 6/2005 | Lambert et al. |
| 2005/0230341 | A1 | 10/2005 | Dong |
| 2006/0016820 | A1 | 1/2006 | Himes et al. |
| 2009/0001043 | A1 | 1/2009 | Benetti |
| 2009/0218345 | A1 | 9/2009 | Elliott |
| 2010/0044335 | A1 | 2/2010 | Blake |
| 2010/0163559 | A1 | 7/2010 | Towers |
| 2011/0168594 | A1 | 7/2011 | Saunders |
| 2013/0075356 | A1 | 3/2013 | Bergida et al. |

FOREIGN PATENT DOCUMENTS

| | | | |
|---|---|---|---|
| EP | 1447334 | A1 | 8/2004 |
| GB | 2370555 | A | 7/2002 |
| KR | 20020048533 | A * | 6/2002 |
| WO | WO 9937190 | A1 | 7/1999 |
| WO | WO 0012404 | A1 | 3/2000 |
| WO | WO 2007090439 | A1 | 8/2007 |

* cited by examiner

DRINKING VESSEL HAVING ENGAGEMENT FEATURES AND CAMOUFLAGING NON-ENGAGEMENT ELEMENTS IN INTAGLIO

CROSS-REFERENCES TO RELATED APPLICATIONS

This is a continuation of U.S. application Ser. No. 14/029,020, filed Sep. 17, 2013, now U.S. Pat. No. 9,821,930, which is a continuation-in-part of U.S. application Ser. No. 13/240,194 filed Sep. 22, 2011, now abandoned, and claims priority to U.S. Provisional Application No. 61/703,637 filed Sep. 20, 2012, the contents of each of which are hereby incorporated by reference as though fully set forth herein.

BACKGROUND DISCUSSION

Vessels configured to be sealed with a reclosable lid are, of course, well known. Threads or other engagement features are provided on the vessel in a region referred to herein as the "engagement feature band." These engagement features have the functional purpose of being engageable with threads or other engagement features on the lid in such a way that the vessel is sealed and that the lid can be thereafter removed and then re-attached to the vessel as desired by, for example, twisting the lid on and off.

In one type of configuration, the engagement features in the vessel's engagement feature band include at least one holding element under which a lug, or other engagement feature, in the lid is slid when the lid is twisted, thereby providing the so-called "holding" function so as to hold the lid in place on the vessel.

Engagement features in the vessel's engagement feature band and/or in the lid typically provide at least two other functions. One of those is the "run-in" function, whereby engagement feature(s) in the lid are guided into position. Another is the "stopping" function, wherein the lid is stopped from twisting so much that its engagement features disengage from the vessel.

The holding, run-in and stopping functions are sometimes collectively referred to herein as the "engagement functions."

The holding, run-in and stopping engagement functions are also in play where the engagement features are threads rather than lugs. The holding function is provided as a result of threads in the lid being interleaved among the threads on the vessel, preventing the lid from being pulled directly upward. The run-in function is provided by one or more of the threads on the vessel lying below the level of the top-most thread. And the stopping function is provided when the inner surface of the top of the lid is pulled increasingly downward as the threads in the lid advance through the threads on the vessel, to a point where the lid can be twisted no further.

SUMMARY

We have recognized that it is desirable to enhance the aesthetic appeal of lidded vessels by at least partially camouflaging the utilitarian function of the engagement features on the vessel so that the engagement features' utilitarian function is less apparent to the consumer than is the case with conventional engagement features, thereby at least partially camouflaging the fact that the engagement features are "the thing that holds the lid in place."

Such camouflaging is particularly advantageous when the vessel is in the form of a lidded drinking glass—such as a lidded wine glass, beer glass, whiskey tumbler or soda glass—that is sold pre-filled and sealed with the wine, beer, whiskey or soda already inside. When the lid is removed from such a vessel, the engagement features—which were mostly or totally hidden under the lid to that point—become exposed. By configuring the engagement features to at least partially camouflage their utilitarian function, the user's drinking experience is enhanced in that it is made to seem to the user much less as though s/he is drinking from a "container" from which a lid has been removed and more as though s/he is drinking from a drinking glass in the usual, more refined way. It is more pleasant to be drinking from a "glass" than to be swigging directly from what could otherwise seem like product packaging.

The camouflaging is achieved in embodiments using one or more camouflaging techniques singly or in combination. One such camouflaging technique is to include on the vessel what we refer to as "non-engagement elements," meaning a feature that does not provide any of the three engagement functions of holding, run-in or stopping. One particularly advantageous camouflaging technique can be to provide non-engagement elements which are in intaglio, that is, sunk below the surface. This can be achieved, for example, by molding or etching. Such features can be positioned behind, around, above, below, next to and/or on the bowl engagement features. The camouflaging effect is particularly strong if the non-engagement element(s) overlay one or more of the engagement features.

Another camouflaging technique is to configure the engagement features themselves in a way that at least partially camouflage their utilitarian nature or purpose. Yet another camouflaging technique is to arrange the engagement feature(s)—or the engagement features combined with the non-engagement elements—in clusters that are calculated to appeal to the viewer's aesthetic sense and to thus induce in the mind of the viewer that there was an aesthetic or artistic intent on the part of the vessel designer as to how the designer arranged the non-engagement and/or engagement elements of a cluster.

Specifics as to desirable configurations and characteristics of the non-engagement elements and engagement features are presented in the Detailed Description hereof.

The utilitarian nature or purpose of the engagement features can be at least partially camouflaged further by positioning the engagement features—and, if present, the non-engagement elements—downwardly from the vessel rim so as to leave a clear space on the outside of the vessel from the rim downward, as disclosed in U.S. patent application Ser. No. 13/240,194 to which priority is claimed herein. We point out in that patent application that such positioning of the engagement features enhances the tactile aspect of user's drinking experience when drinking from a pre-filled vessel in that the user's lips encounter an unobstructed surface rather than the engagement features. Thus the user gets a very different drinking experience than is gotten from when one simply drinks "out of the bottle"—as happens when one drinks from a conventional screw-top soda bottle and one's mouth encounters the threads disposed at rim level. And, advantageously, such downward displacement used in conjunction with one or both of the two above-mentioned camouflaging techniques further serves to at least partially camouflage the engagement features' utilitarian nature or purpose. This is at least in part a result of the fact that people are very much used to the idea that a container's engagement features are disposed right at the rim of the vessel. There will thus be a tendency for them to not perceive engagement features that are displaced away from the rim as being engagement features at all.

We have conducted limited informal consumer tests in which we have presented people with both drawings and physical embodiments of vessels embodying principles of the present disclosure and asked what function or purpose is served by the engagement features. The vast majority did not recognize the engagement features' utilitarian function.

DETAILED DESCRIPTION

Figure 1:
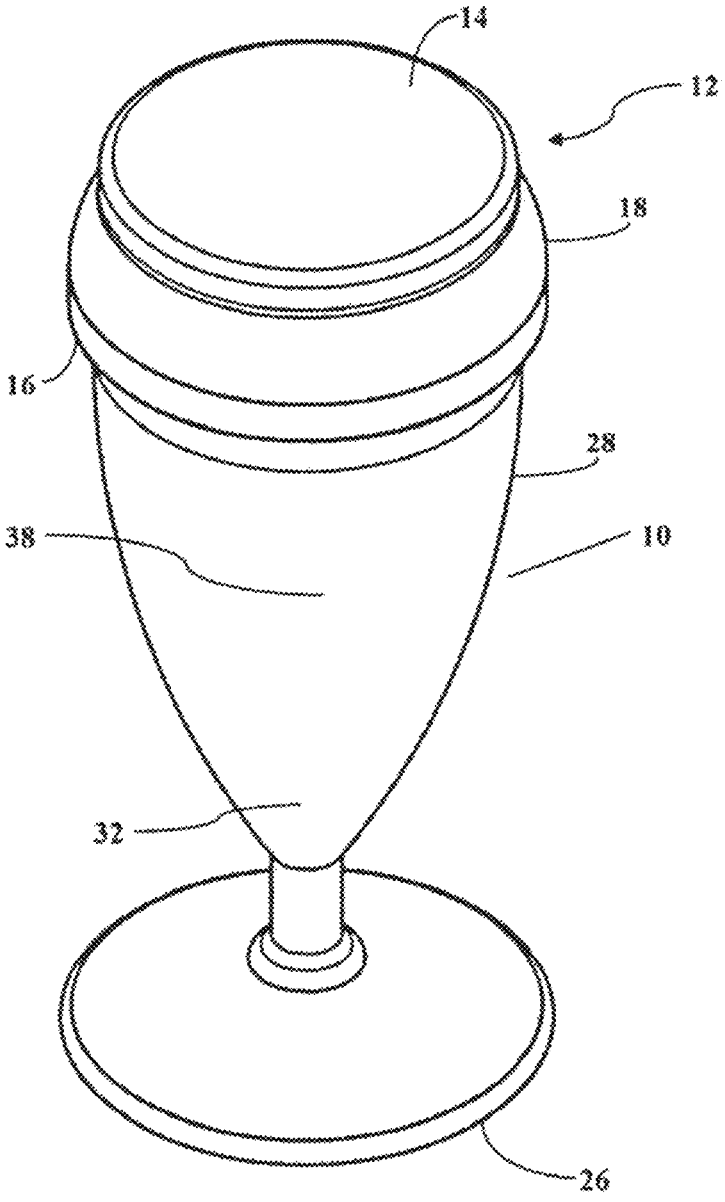
FIG. 1 is a perspective view of a beverage vessel, with a resealable lid, the vessel embodying principles of the present disclosure.

The Figures show various embodiments of the disclosure. In the various views, conventional drinking vessel elements, such as a drinking rim and base, are given the same reference numeral throughout all the figures.

Figure 2:
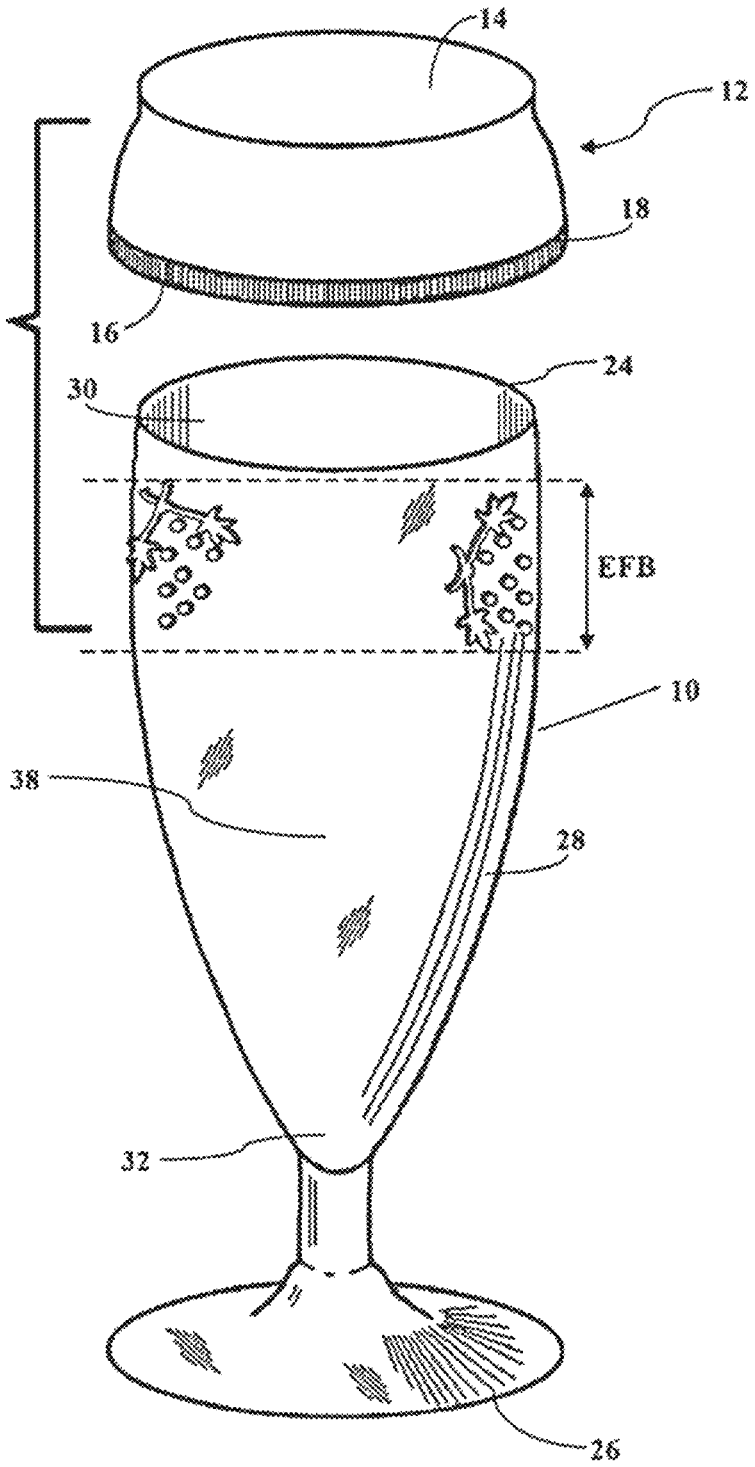
FIG. 2 shows the vessel of FIG. 1 with its lid removed so as to expose the vessel's engagement feature band.
Figure 4:
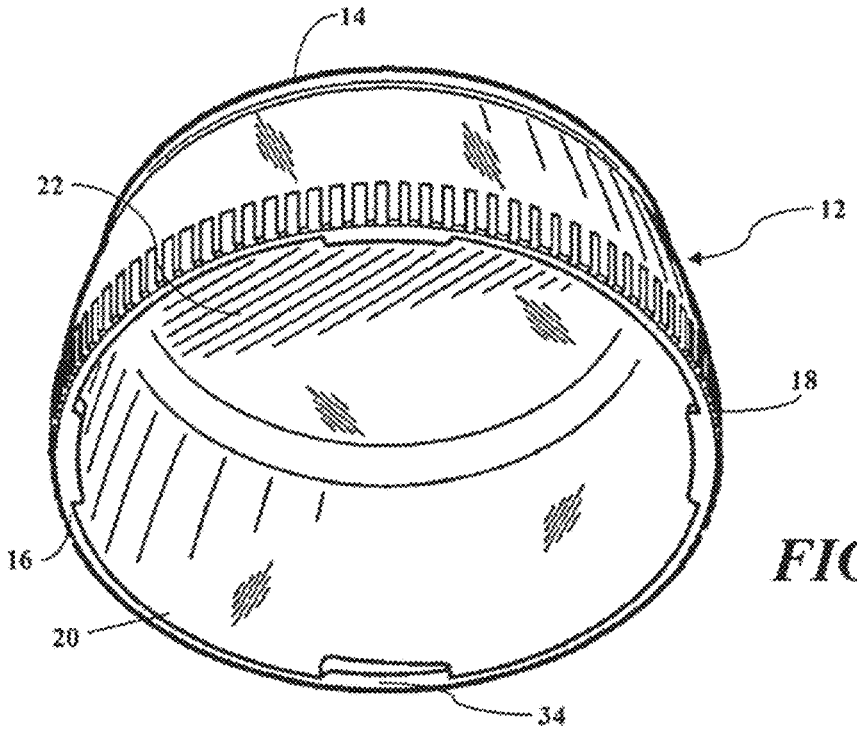
FIG. 4 is a bottom perspective view of the lid used to seal the vessel of FIGS. 1-3, as well as many other vessels disclosed herein.
Figure 5:
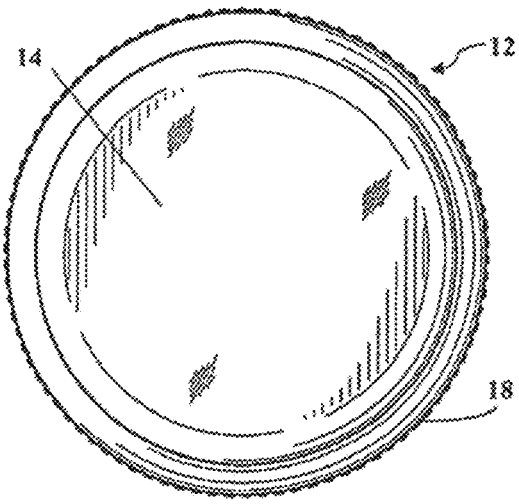
FIG. 5 is a top view of the lid used to seal the vessel of FIGS. 1-3, as well as many other vessels disclosed herein.
Figure 6:
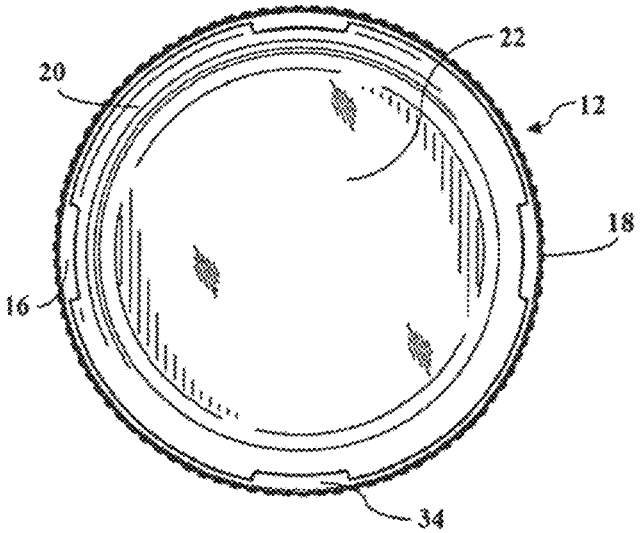
FIG. 6 is a bottom view of the lid used to seal the vessel of FIGS. 1-3, as well as many other vessels disclosed herein.

FIG. 1 is a perspective view of a single serving beverage vessel 10 having an associated resealable lid 12. FIG. 2 is a perspective view of vessel 10 but with lid 12 having been twisted off, revealing a set of engagement and non-engagement elements within an engagement feature band EFB, about which more hereinbelow in connection with FIG. 3, which is a detail view of the features within the engagement feature band. FIGS. 4-6 are bottom perspective, top plan and bottom plan views of lid 12.

Vessel 10 may be made from any appropriate material, including glass or a plastic material such as food grade polycarbonate. Thus, although the word "glass" may be used at various points throughout this specification, it is to be understood that the word "glass" is being used in the sense of a drinking vessel, irrespective of the material that the vessel is made from.

Vessel 10 includes a top portion, or bowl, for holding a beverage or other contents. The bowl has a top end, or rim, 24, a bottom end, or base, 26, and at least one sidewall 28, which forms a cavity with at least one interior surface 30, and a bottom 32. This cavity holds the contents 38.

The lid 12 has a top end 14, a bottom end 16, at least one sidewall 18, an interior surface 20, and engagement features 34 located near or at the bottom 16 interior surface 20 of the lid 12. The lid 12 may be made from plastic, aluminum, a metal alloy, or some combination thereof. The vessel and lid are configured to allow at least for the lid to be twisted off, or otherwise removed, by a consumer after having been twisted on and sealed—or otherwise put in place—by a manufacturer or bottler. In the illustrated embodiments, the lid can be twisted onto and off of the vessel any number of times, resealing the vessel so as to prevent accidental spillage as well as to store the beverage for another occasion.

Lid 12 has a liner 22 located on the interior surface 20 of the top end 14. The liner 22 is a liquid resistant coating or compressible insert of a type known in the prior art made often from a polymer/pulp combination that assures seal integrity. The liner 22 enables the lid to seal off the top end, or rim, 24 of the vessel and keep the contents 38 fresh. Lid engagement features 36 on the exterior surface 28 of vessel 10 interlock with the engagement features 34 on the inside surface 20 of the lid 12—which are in the form of lugs—thus tightening the lid 12 and bringing the liner 22 into contact with rim 24 and creating an airtight seal.

The part of the vessel 10 exterior surface 28 that extends upwardly from the engagement feature band may taper as it approaches the vessel rim 24. This enables the user to comfortably consume beverage from the vessel rim 24. The lid 12 comes down over this tapered region. The vessel 10 sidewall 28 below the engagement features 36 is thick enough to resist breakage from contact with other vessels during filling and shipping.

This description characterizes the vessels disclosed herein using terms like "top," "bottom," "up", "down," "horizontal" and "vertical". These are, of course relative terms, as they depend on the orientation of the vessel itself. For purposes of this description, those terms are used with respect to the orientation of the vessels as shown in the side view figures. Thus in FIG. 2, for example, rim 24 is at the vessel top, base 26 is at the bottom, "up" is the direction from base 26 to rim 24, "down" is the opposite to that, "vertical" is the direction between the base and the rim and "horizontal" is a direction perpendicular to that, i.e. a direction parallel to the plane in which rim 24 lies.

An area on the sidewall of vessel 10 is engagement feature band EFB having upper and lower limits UL and LL, respectively. The upper and lower limits UL and LL are circles lying in respective planes that are parallel to a plane in which the vessel rim 24 lies.

There are at least two—in fact, four—engagement feature clusters C within the engagement feature band. The engagement feature clusters C are rotationally displaced versions of one another. One way to define what constitutes a "cluster"—given some number of elements or features on the vessel or bowl—is that the circumferential distance between any two clusters on the surface of the vessel bowl is greater than the largest circumferential distance between any two adjacent constituents of a cluster.

Figure 3:
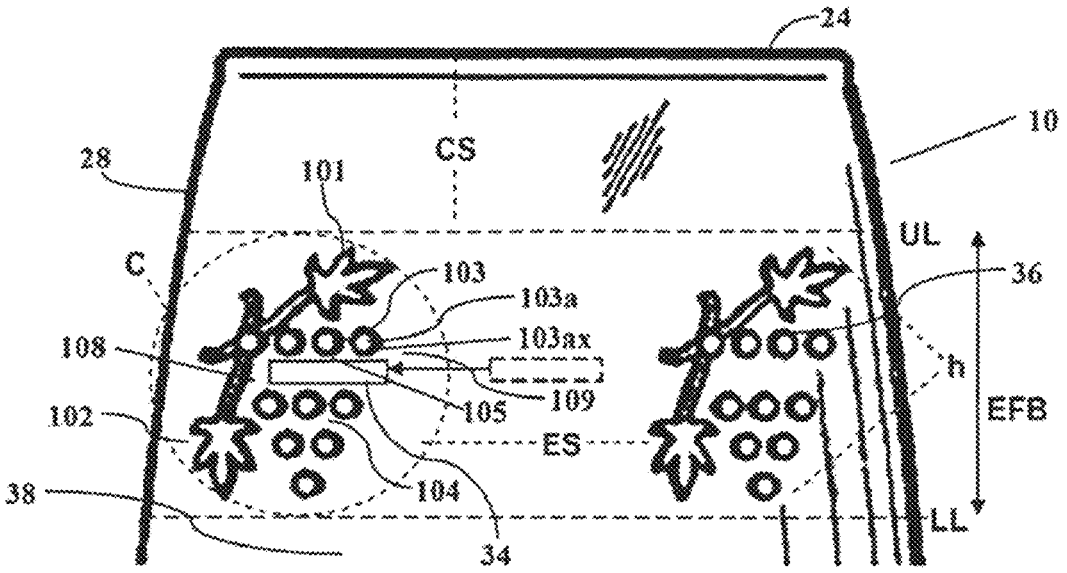
FIG. 3 is a detail view of the engagement feature band of the vessel of FIGS. 1-2.

One of the engagement features 34 of lid 12 is shown in FIG. 3 in two positions: a starting position prior to any engagement with cluster C, in staging area 109 and an ending position within engagement track 105 that is reached when the lid has been fully twisted onto the vessel.

In the present specification, the word "engagement feature" is used in the context of the vessel to refer to a group of one or more spatially separate embossments or other protrusions from the vessel side wall that provide an engagement function. The word "element" is used in a more generic sense to mean any one or more such embossments or protrusions, whether or not providing an engagement function and whether or not connected to, or intersecting with, any other such element. An engagement feature may thus be made up of one or more elements.

Given that definitional convention, cluster C can be seen to comprise eleven elements: two leaved branches 101 and 102, four dots 103 and five dots 104. Of the elements just noted, elements 103 as group comprise an engagement feature. Specifically, they provide the holding function in that they prevent the lid from being pulled directly upward once lug 34 is in its final position. Often the engagement features on a vessel include at least one generally horizontal engagement element that provides the holding function. There may be a single such element or, as in the embodiment of FIG. 3, there may be two or more of them serving as a group to provide the holding function. In either case, the elements providing the holding function are configured to provide a generally horizontal barrier under which a lug or other lid engagement feature is slid, thereby preventing the lid from being pulled upward. An open region of the engagement feature band, referred to herein as the "staging area" allows a lug or other lid engagement feature to be aligned with the area under the holding element(s), referred to herein as the "engagement track" prior to the lid being twisted into place.

The same element(s), or other elements, that provide the holding function may also provide one or both of two other engagement functions. One of those other engagement functions is the "run-in" function, by which the lid engagement feature(s) are guided or urged into the engagement track. In the embodiment of FIG. 3, one of the three engagement elements 103—specifically element **103*a*—provides the run-in function. Specifically, as lug 34 moves leftward from staging area 109, it encounters edge 103*ax* of element 103*a*. Since edge 103*ax* is rounded, element 103*a* serves to guide lug 34 into engagement track 105**.

Another engagement function is the "stopping" function, wherein the lid is stopped from twisting so much that its engagement features disengage from the engagement features on the vessel. In the embodiment of FIG. 3, element 102 provides the stopping function in that it prevents any further leftward movement of lug 34 and thus prevents a disengagement of the lid from the vessel.

The remainder of the elements of cluster C are non-engagement elements, as discussed in further detail hereinbelow.

Figure 7:
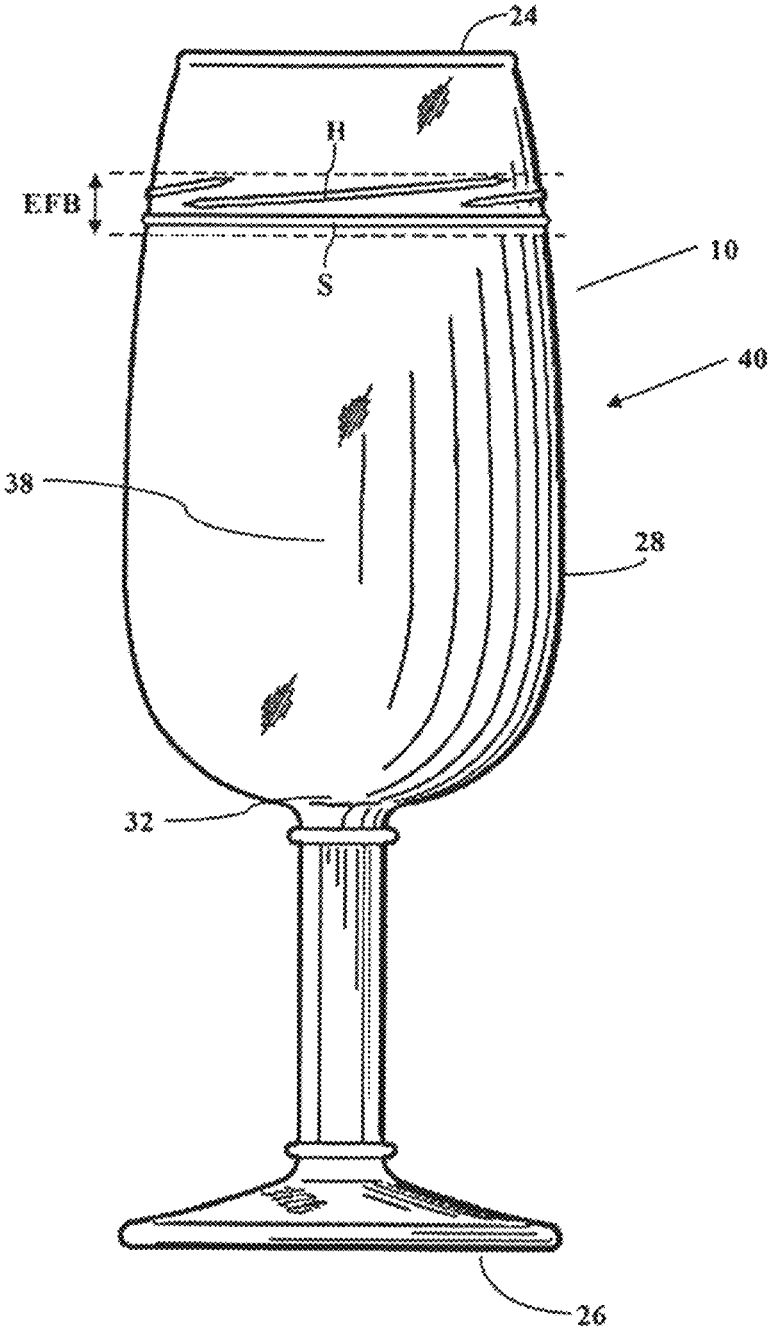
FIG. 7 is a side view of another beverage vessel embodying principles of the disclosure.
Figure 8:
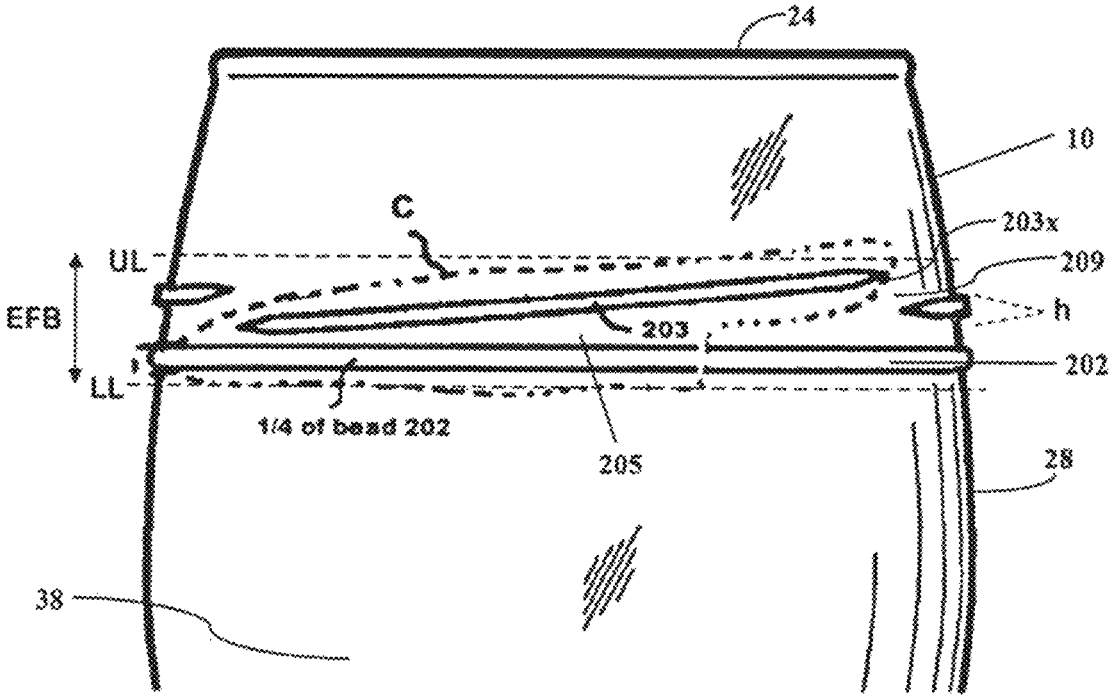
FIG. 8 is a detail view of the engagement feature band of the vessel of FIG. 7.
Figure 9:
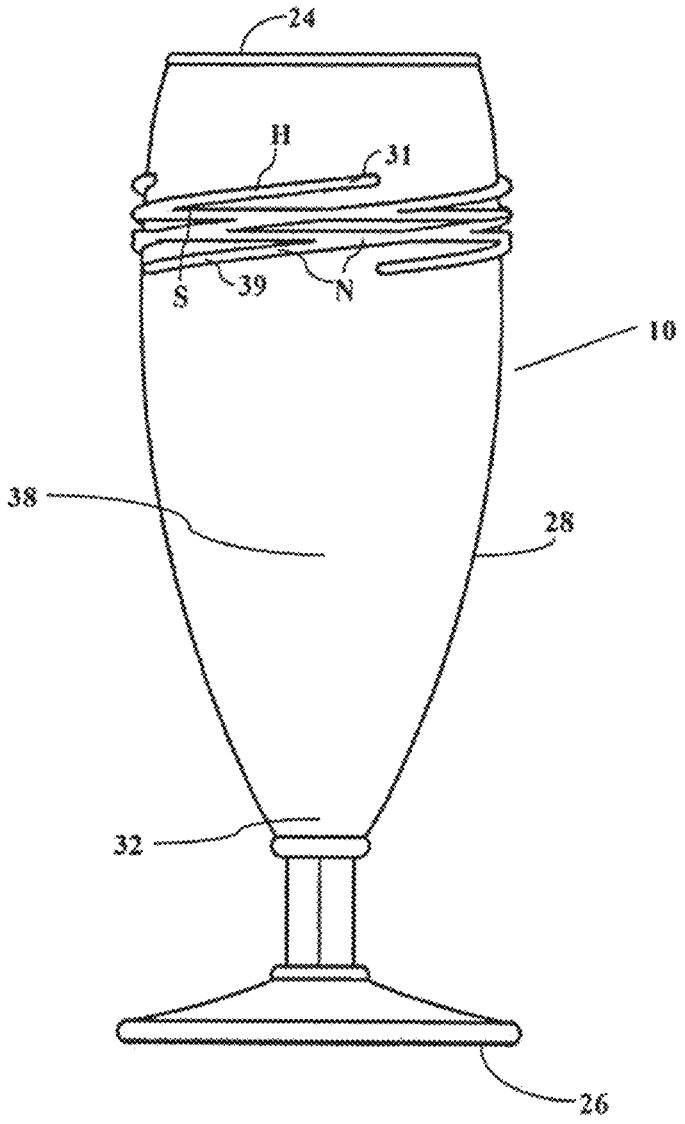
FIG. 9 is a side view of yet another beverage vessel embodying principles of the present disclosure.
Figure 10:
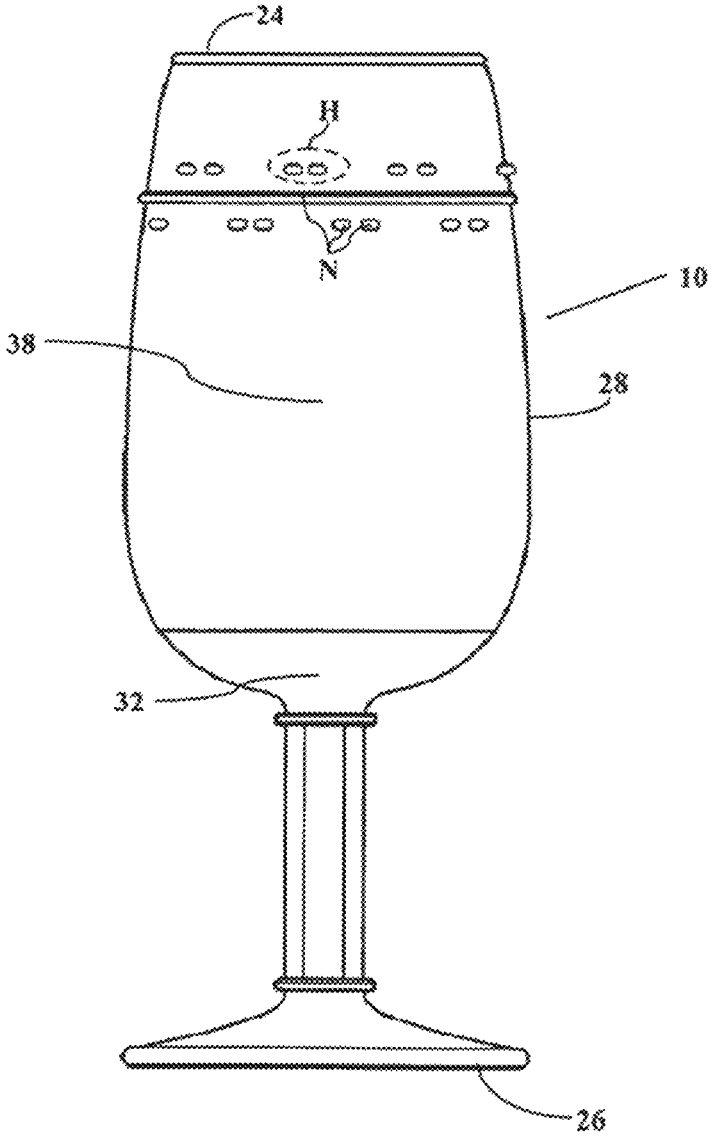
FIG. 10 is a side view of yet another beverage vessel embodying principles of the present disclosure.
Figure 11:
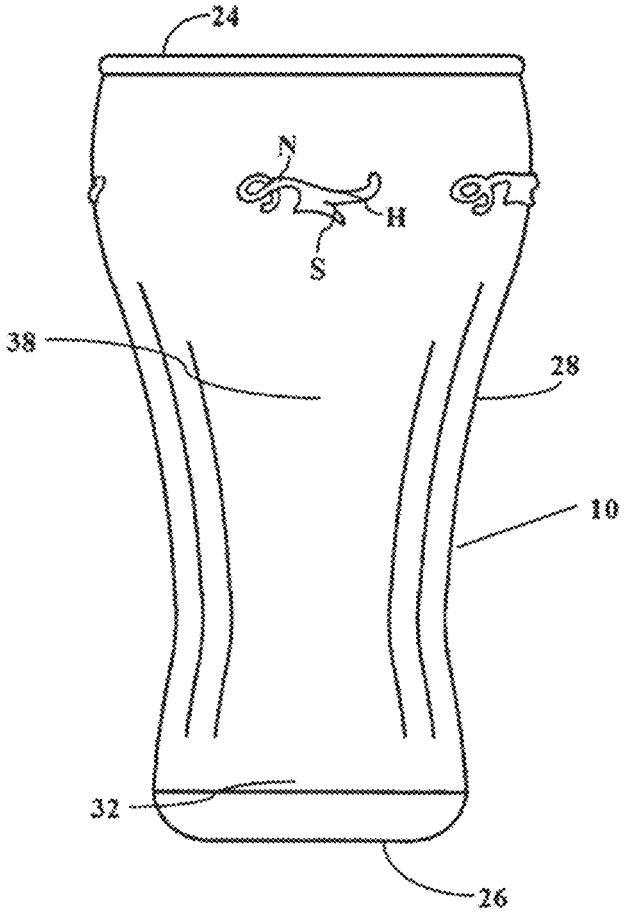
FIG. 11 is a side view of yet another beverage vessel embodying principles of the present disclosure.
Figure 12:
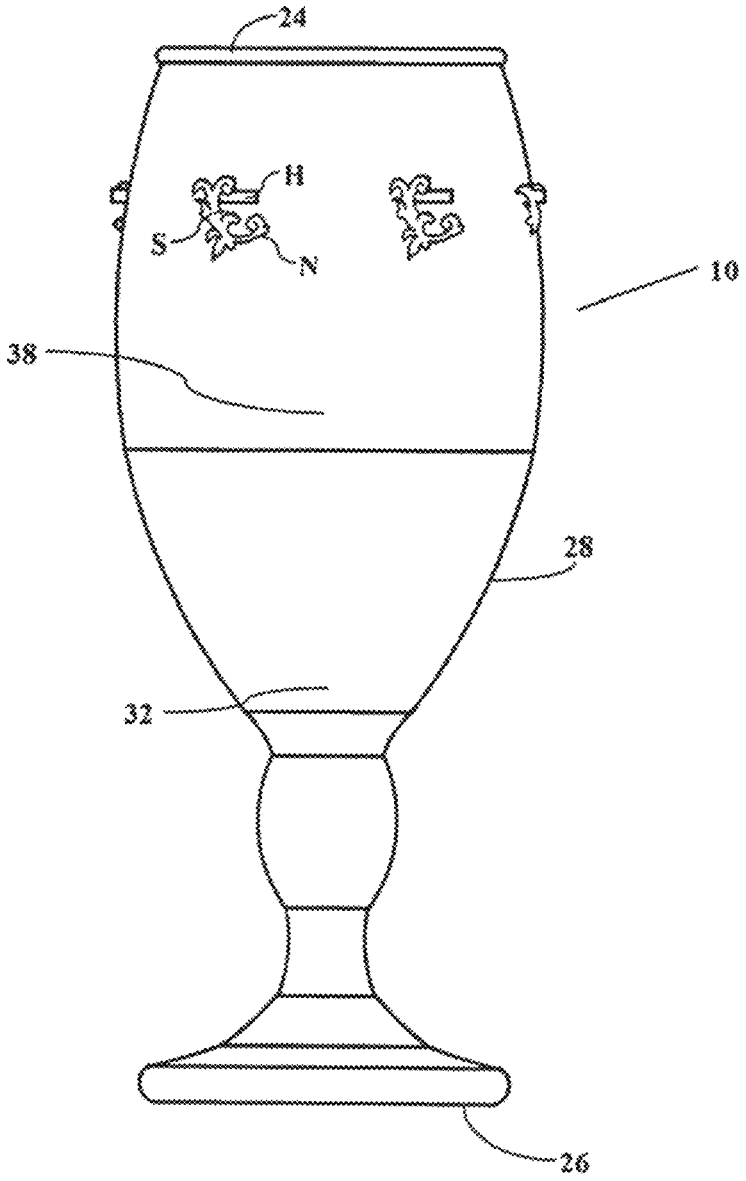
FIG. 12 is a side view of yet another beverage vessel embodying principles of the present disclosure.
Figure 13:
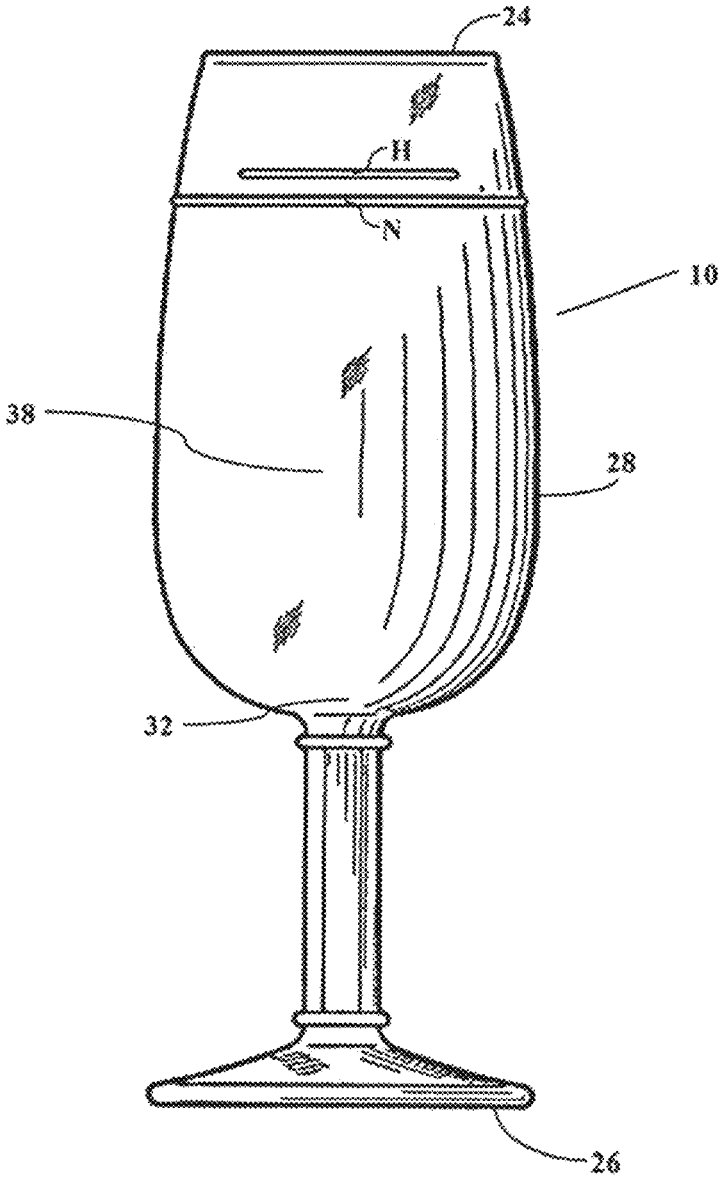
FIG. 13 is a side view of yet another beverage vessel embodying principles of the present disclosure.
Figure 14:
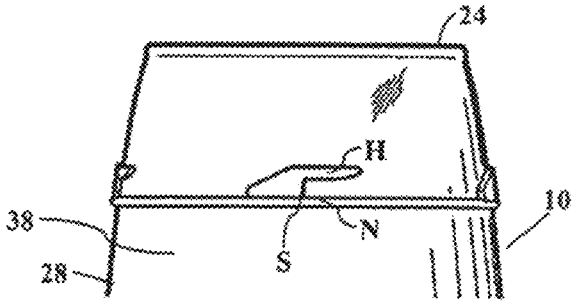
FIG. 14 is a side view of an upper portion of yet another beverage vessel embodying principles of the present disclosure.
Figure 15:
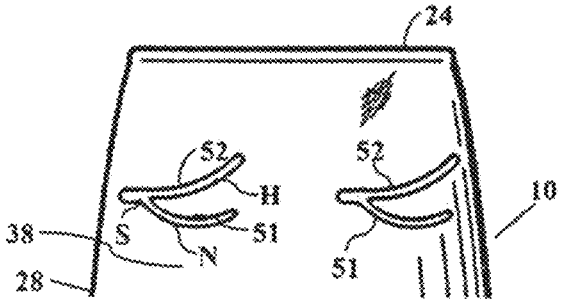
FIG. 15 is a side view of an upper portion of yet another beverage vessel embodying principles of the present disclosure.
Figure 16:
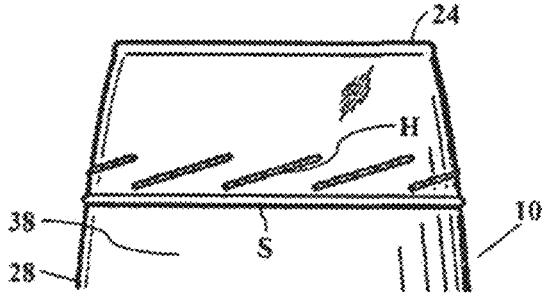
FIG. 16 is a side view of an upper portion of yet another beverage vessel embodying principles of the present disclosure.
Figure 17:
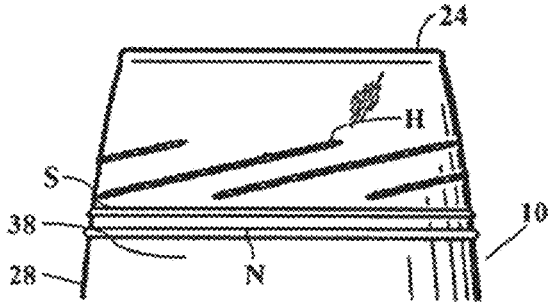
FIG. 17 is a side view of an upper portion of yet another beverage vessel embodying principles of the present disclosure.
Figure 18:
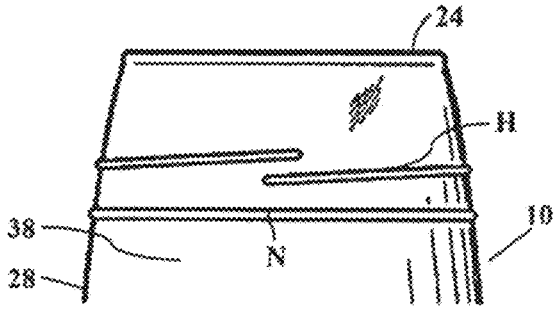
FIG. 18 is a side view of an upper portion of yet another beverage vessel embodying principles of the present disclosure.
Figure 19:
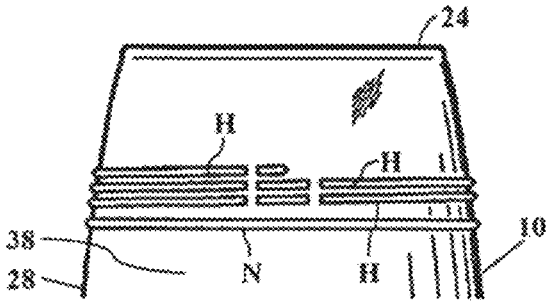
FIG. 19 is a side view of an upper portion of yet another beverage vessel embodying principles of the present disclosure.
Figure 20:
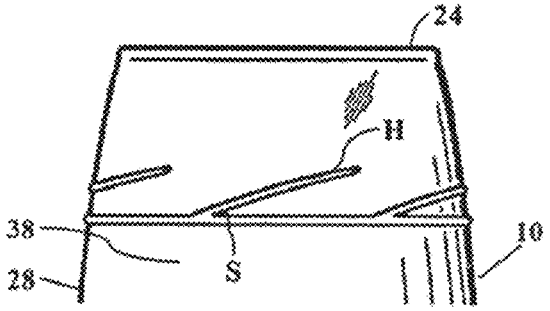
FIG. 20 is a side view of an upper portion of yet another beverage vessel embodying principles of the present disclosure.
Figure 21:
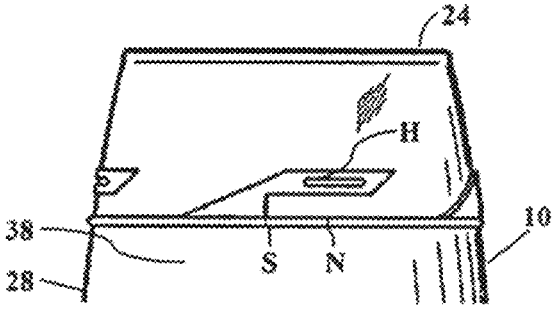
FIG. 21 is a side view of an upper portion of yet another beverage vessel embodying principles of the present disclosure.
Figure 22:
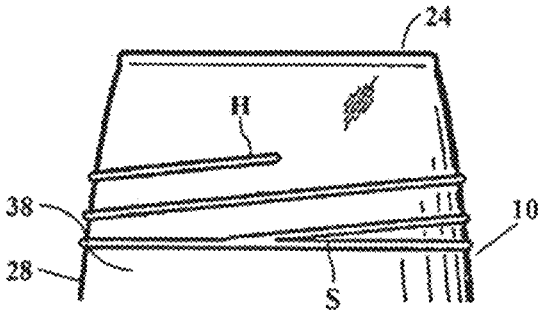
FIG. 22 is a side view of an upper portion of yet another beverage vessel embodying principles of the present disclosure.
Figure 23:
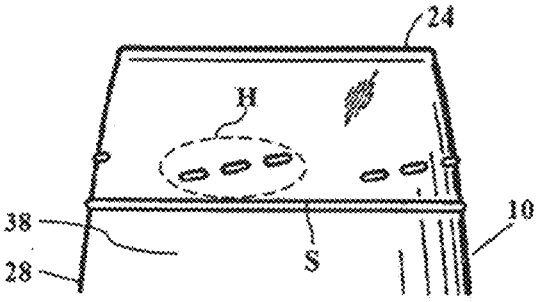
FIG. 23 is a side view of an upper portion of yet another beverage vessel embodying principles of the present disclosure.
Figure 24:
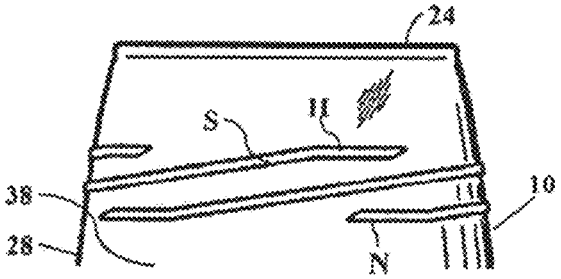
FIG. 24 is a side view of an upper portion of yet another beverage vessel embodying principles of the present disclosure.
Figure 25:
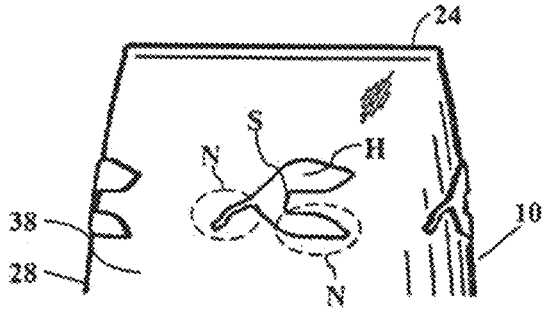
FIG. 25 is a side view of an upper portion of yet another beverage vessel embodying principles of the present disclosure.
Figure 26:
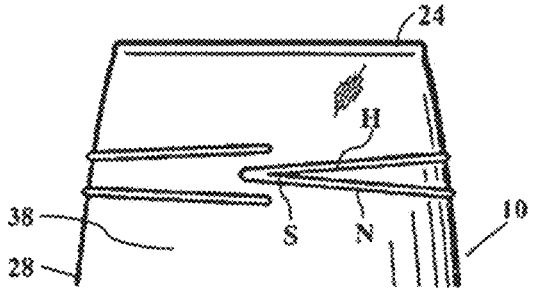
FIG. 26 is a side view of an upper portion of yet another beverage vessel embodying principles of the present disclosure.

Another embodiment is shown in FIGS. 7 and 8. In particular, FIG. 7 is a side view of a single serving beverage vessel 40 adapted to receive lid 12. FIG. 8 is detail view of features on the sidewall of vessel 40 within an engagement feature band EFB having upper and lower limits UL and LL, respectively.

As illustrated by this embodiment, the elements that are a part of a single individual cluster may or may not provide all of the engagement functions. Rather, one or more of the engagement functions may be provided, in particular embodiments, by one or more engagement element(s) that is (are) shared between or among clusters.

Thus in one aspect, we can say that each of the clusters C of this embodiment comprises the single element 203, as is denoted in FIG. 8. There are four such engagement feature clusters that are rotationally displaced versions of one another. The holding function is provided by element 203. The run-in function is provided by the fact that each element 203 comes to a point at the right so that as a lug of the lid moves leftward from the staging area 209, it encounters edge 203*x* of element 203. Since edge 203*x* is on an upward tilt, it serves to guide the lug into the engagement track 205.

One of the engagement functions—specifically, the stopping function—is provided by an element 202 that is shared among the clusters. The element is the bead 202, which is a continuous bead running around the circumference of vessel 10. Bead 202 serves as a stop element for each cluster. Without bead 202 being in place, the lid might be twistable to a point that the lugs 34 can continue beyond the leftmost end of the elements 203 and the lid will never be securely "seated."

From another point of view, however, one could imagine bead 202 as being made up of (or divided into) four conjoined segments, each (in this case) having a length that is one-fourth the length of the overall bead 202. Then one could regard each cluster C as comprising two elements: one of the elements 203 and a respective one of the segments of the bead 202. This is illustrated in FIG. 8.

Further embodiments are shown in FIGS. 9-42. Each of them includes one or more engagement elements within an engagement feature band. Elements that provide a holding function are designated with an H. In those embodiments where a stopping function is provided by an element within the engagement feature band, such elements are designated with an S. Although not necessarily shown explicitly in the drawing, at least some of the holding elements in the embodiments of FIGS. 9-42 are so configured as to provide the run-in function such as by way of rounded or slanted-up edges as shown in FIGS. 11, 14, 15, 21, 24, 25, 32, 40, 41, 42.

Many of the embodiments of FIGS. 9-42 also include non-engagement elements, i.e., elements that provide neither a holding, run-in or stopping function. Such elements are designed with an N. Non-engagement elements need to be arranged relative to the engagement elements such that the non-engagement elements do not interfere with the free movement of the lugs or other engagement features in the lid when the lid is being applied or removed from the vessel.

Figure 27:
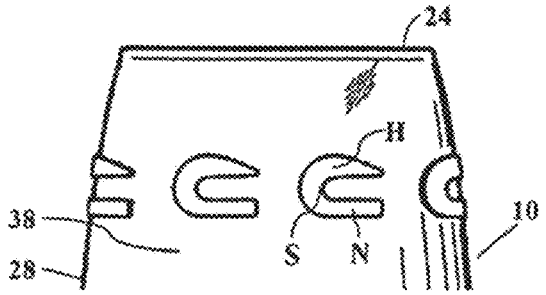
FIG. 27 is a side view of an upper portion of yet another beverage vessel embodying principles of the present disclosure.
Figure 28:
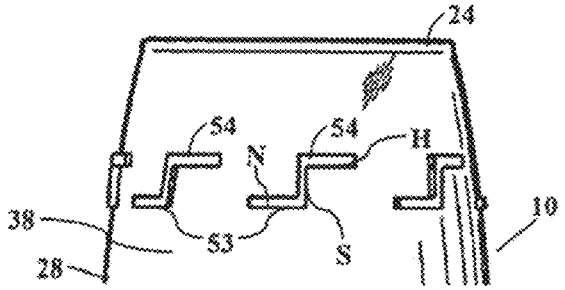
FIG. 28 is a side view of an upper portion of yet another beverage vessel embodying principles of the present disclosure.
Figure 29:
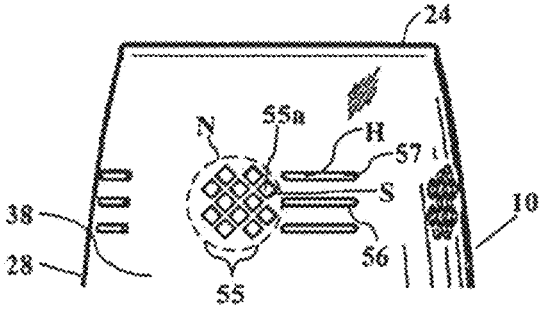
FIG. 29 is a side view of an upper portion of yet another beverage vessel embodying principles of the present disclosure.
Figure 30:
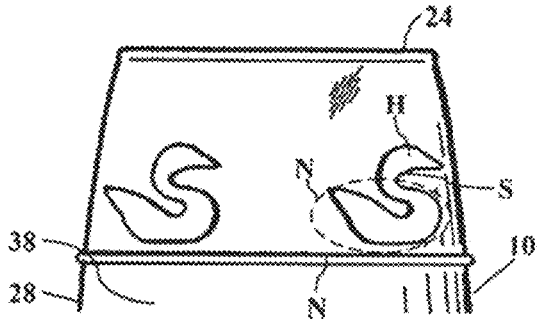
FIG. 30 is a side view of an upper portion of yet another beverage vessel embodying principles of the present disclosure.
Figure 31:
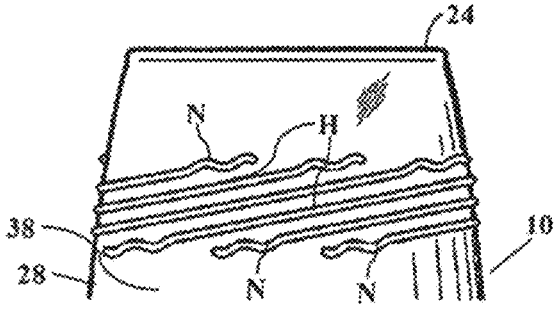
FIG. 31 is a side view of an upper portion of yet another beverage vessel embodying principles of the present disclosure.
Figure 32:
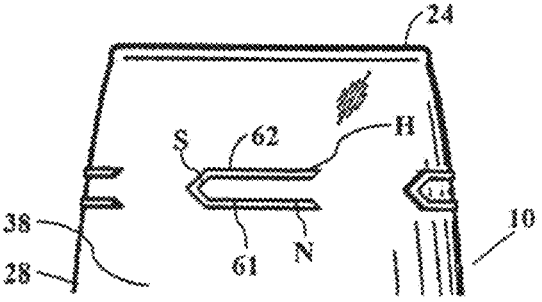
FIG. 32 is a side view of an upper portion of yet another beverage vessel embodying principles of the present disclosure.
Figure 33:
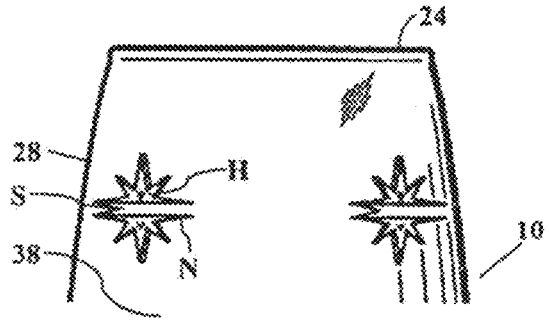
FIG. 33 is a side view of an upper portion of yet another beverage vessel embodying principles of the present disclosure.
Figure 34:
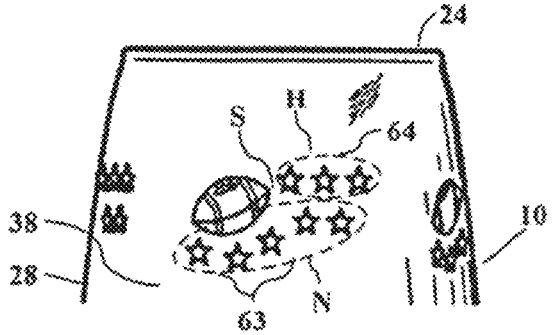
FIG. 34 is a side view of an upper portion of yet another beverage vessel embodying principles of the present disclosure.
Figure 35:
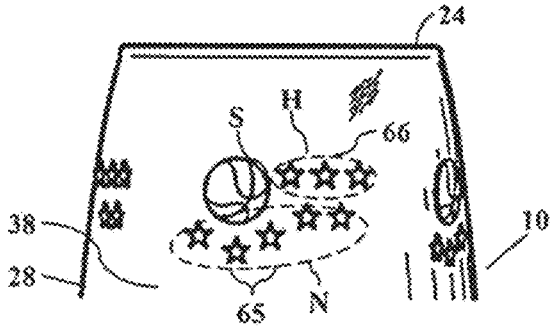
FIG. 35 is a side view of an upper portion of yet another beverage vessel embodying principles of the present disclosure.
Figure 36:
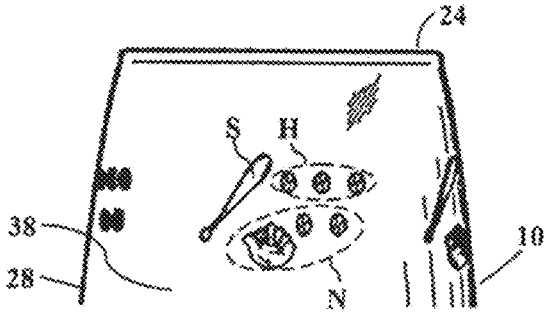
FIG. 36 is a side view of an upper portion of yet another beverage vessel embodying principles of the present disclosure.
Figure 37:
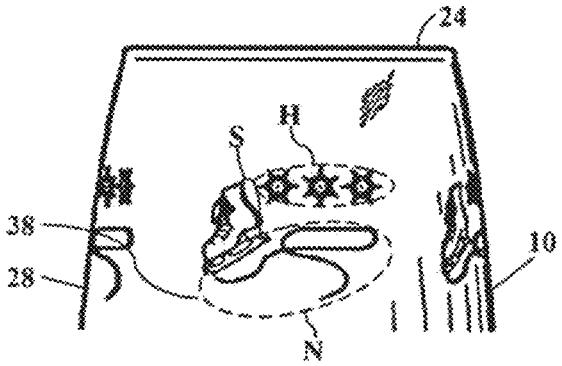
FIG. 37 is a side view of an upper portion of yet another beverage vessel embodying principles of the present disclosure.

We note at this point the methodologies employed in the inclusion of the H, S and N designators. In particular, where a particular FIG. shows full or partial repetitions of a cluster, a representative one stopping element and/or holding element, rather than each such element, may be designated with an S or an H. FIG. 27 is an example of one such FIG. Where multiple elements provide a particular function in combination, or where multiple elements are all non-engagement elements, those are sometimes encompassed with a dashed line to which the lead line for the H, S or N designation leads. This is seen, for example, in FIGS. 34-37. In a number of the embodiments, different portions of a single continuous element may provide the holding and/or stopping and/or run-in functions and/or may be not providing any engagement function. Thus, in some of the FIGS, the lead lines for H and/or S and/or N designations are intended to lead to a general region of the element that is providing the holding or stopping function or that is a non-engagement portion of the element, as will be apparent in each case. An example of this is FIG. 11, in which respective portions of the single continuous element that makes up each cluster provide the holding (H) and stopping (S) function and another portion is a non-engagement feature (N). In some such FIGS, where it seemed pedagogically useful, a dashed line encompasses the region in question, such as in FIG. 25.

Various embodiments of engagement features embodying principles of the disclosure can be configured in such way as to engage with a lid that uses screw threads as the engagement features rather than lugs. (In either case, the engagement features may, advantageously, be configured in such a way that the lid can twist on and off easily with less than one-half turn.) Among these embodiments are those shown in FIGS. 9, 16 to 20, 23, 27 28, 29, 30, and 38.

It may also be observed that, for some embodiments, the stopping function may be provided by the configuration of the engagement features in the matching lid. The embodiments of FIGS. 10, 13, and 23 help illustrate this point.

Non-Engagement Elements at Least Partially Camouflage Utilitarian Nature or Purpose of the Engagement Features In accordance with an aspect of the disclosure, we have recognized that the utilitarian, or functional, nature or purpose of the engagement features of a vessel such as a drinking glass, can be effectively at least partially camouflaged in particular embodiments by including one or more non-engagement elements within the engagement feature band. By a "non-engagement element" we mean a feature that does not provide any of the three engagement functions of holding, run-in or stopping. For a non-engagement element to be "within the engagement feature band" means that at least a portion of the non-engagement feature is closer to the rim of the bowl than at least a portion of at least one of the engagement features.

In the embodiment of FIGS. 1-3, elements 101 and 104 are such non-engagement elements. Note that the engagement functions of holding, run-in and stopping are provided in that embodiment by other elements—specifically, the twig 102 and the row of dots 103, as described above. Non-engagement elements in the various other embodiments are designated by N.

The presence within the engagement feature band of the non-engagement elements—i.e. features that have no apparent (indeed, no actual) utilitarian or functional purpose—serves to at least partially camouflage the utilitarian or functional nature or purpose of the engagement features in at least two ways: For example, the presence of the non-engagement element(s) attracts viewers' attention away from the engagement features. Moreover, the presence of features in the engagement feature band that appear to be extraneous and/or merely decorative creates a pull-through effect. That is, it tends to send a visual message, or cue, and/or to engender an impression in the mind of the viewer that all of the features in the engagement feature band are merely decorative and thus at least partially camouflages the fact that the engagement features within the engagement feature band are, in fact, utilitarian.

Non-engagement Element(s) Substantially Identical to Engagement Element(s)

The utilitarian nature or purpose of the engagement elements can be at least partially camouflaged by the presence of non-engagement elements that are identical or very similar to one or more of the engagement elements. The perception on the part of the viewer that a particular element is merely decorative tends to lead the viewer to the perception that other elements that look the same are also merely decorative, even though they may, in fact, be utilitarian or functional. Thus in FIG. 3, for example, the cluster of dots 104 would certainly appear to have no utilitarian function, tending to lead the viewer to perceive that this is true for all of the dots within cluster C. So, too, in FIG. 9, the presence of non-engagement elements 39 tends to at least partially camouflage the utilitarian engagement function of elements 31, which are geometrically similar to elements 39. Similar effects can be seen in FIG. 15 (compare engagement element 52 to non-engagement element 51); in FIG. 28 (compare engagement element 54 to non-engagement element 53); in FIG. 29 (compare engagement element 57, which provides the holding function, to non-engagement elements 56 and also compare element 55*a*, which provides the stopping function, with the remainder of the elements 55, each other one of which is a non-engagement element); in FIG. 32 (compare engagement element 62 to non-engagement element 61); in FIG. 34 (compare engagement elements 64 to non-engagement elements 63); in FIG. 35 (compare engagement elements 66 to non-engagement elements 65);

Non-engagement Element(s) Continuous with or Extension of Engagement Feature(s)

The appearance (and reality) that the non-engagement element(s) are merely decorative—and thus at least partially camouflaging the utilitarian nature or purpose of the engagement features by virtue of the above-mentioned pull-through effect—can be further enhanced by having one or more non-engagement elements be continuous with, and/or an extension of, one or more of the engagement features. This serves in at least two ways to at least partially camouflage further the utilitarian or functional nature or purpose of the said one or more engagement features.

a) Such non-engagement element(s) imbue such engagement features with a decorative quality, and b) the surface area of the resulting combined engagement/non-engagement element is greater—and potentially much greater—than is required for the engagement feature to carry out its engagement function, thereby giving the impression that the engagement feature is not an engagement feature at all. This can be seen at least in the embodiments of FIGS. 1-3, 9, 11, 12, 15, 21, 25, 27, 28, 30, 32, 33, 38, 39, 30 and 42.

Non-engagement Element Geometry

Figure 38:
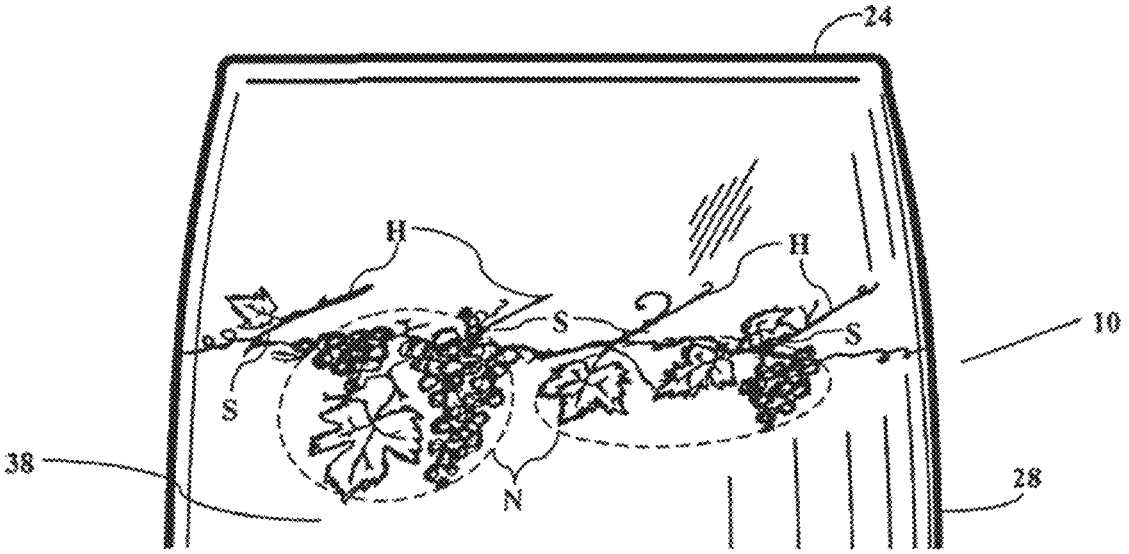
FIG. 38 is a side view of an upper portion of yet another beverage vessel embodying principles of the present disclosure.
Figure 39:
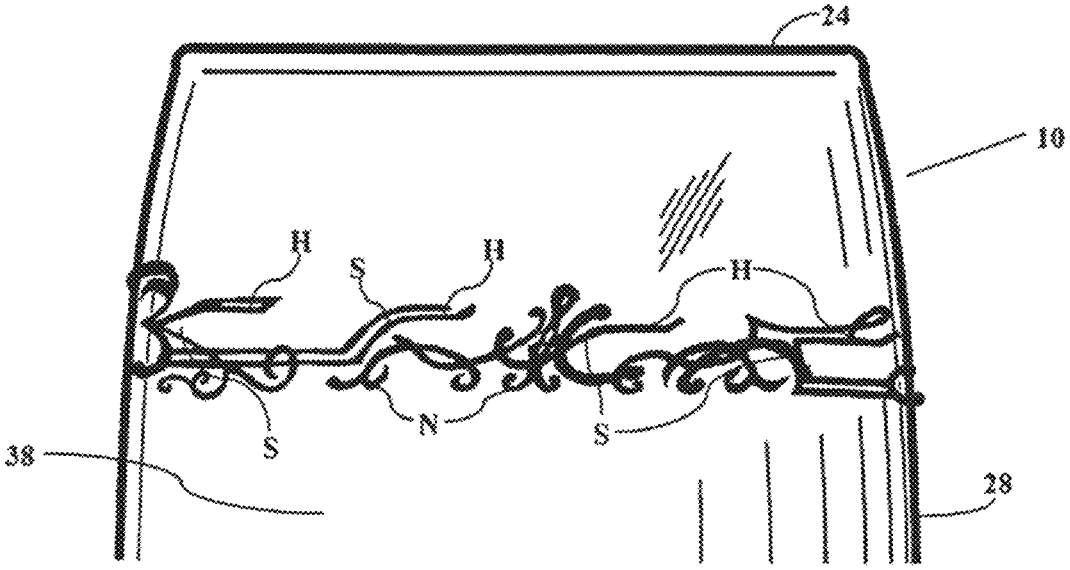
FIG. 39 is a side view of an upper portion of yet another beverage vessel embodying principles of the present disclosure.
Figure 41:
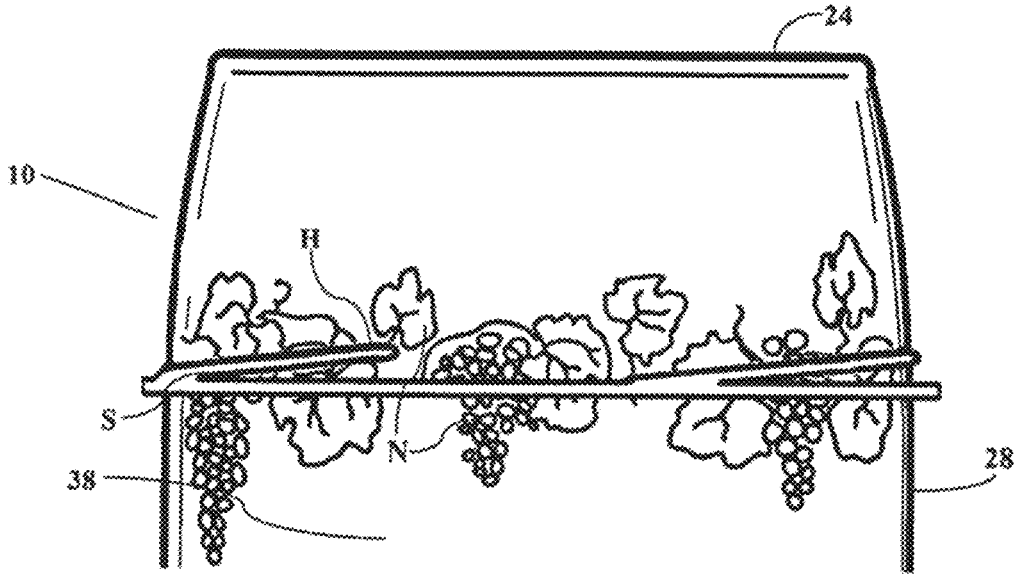
FIG. 41 is a side view of an upper portion of yet another beverage vessel embodying principles of the present disclosure.
Figure 42:
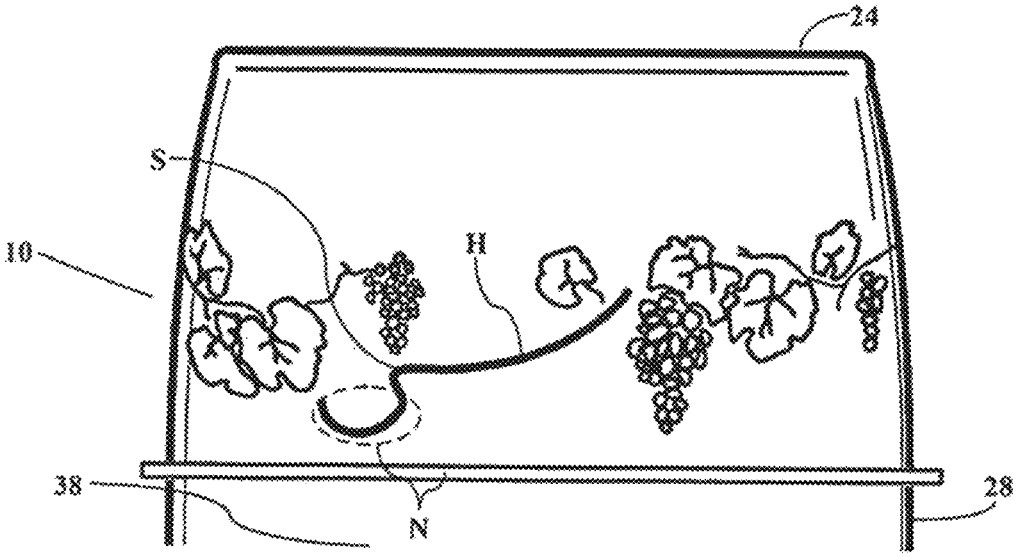
FIG. 42 is a side view of an upper portion of yet another beverage vessel embodying principles of the present disclosure.

The appearance (and reality) that the non-engagement elements(s) are merely decorative—and thus at least partially camouflaging the utilitarian nature or purpose of the engagement features by virtue of the above-mentioned pull-through effect—can be further enhanced by virtue of the non-engagement element(s) having an overall geometry, or at least one geometric feature, that does not typically appear within the engagement feature band of a typical lidded vessel, e.g., the area at the top of a lidded vessel having the familiar screw threads. For example, a non-engagement element within a given cluster may have at least one curved or arcuate edge. This can be seen at least in the embodiments of FIGS. 3, 11, 12, 15, 25, 27, 30, 34-40, and 42. As other examples, non-engagement element(s) within a given cluster may be one or more of the following: a radially or axially symmetric two- or three-dimensional geometrical shape, such as a dot (FIG. 3), diamond (FIG. 29) or a star (FIGS. 34-35); a fanciful or "arbitrary" shape (FIGS. 11, 12, 33 and 39); or a representation of all or part of a recognizable three-dimensional real-life-object, such as a piece of sports equipment (FIGS. 34-37) or an object from nature, e.g. a leafed twig (FIG. 3); an animal (FIG. 30) or grapes and leaves on a grapevine (FIGS. 38, 41, 42).

Figure 40:
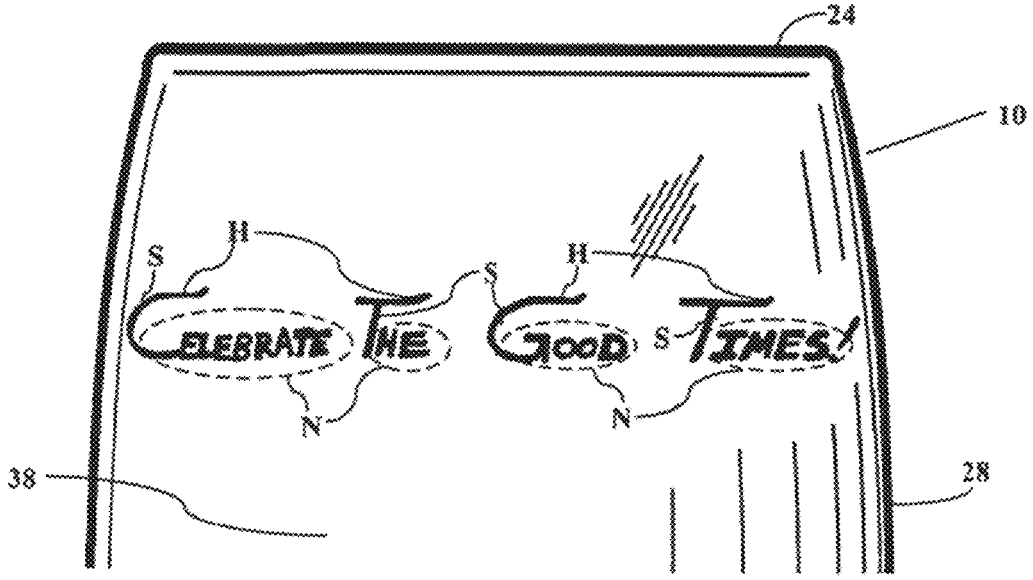
FIG. 40 is a side view of an upper portion of yet another beverage vessel embodying principles of the present disclosure.

A similar effect is achieved if one or more of the non-engagement elements are configured as, for example, an organizational logo, an alphanumeric character, a word or words that may convey a slogan or other textual message, or some other graphic element (FIG. 40).

Non-engagement Element Dimensions

The appearance (and reality) that the non-engagement elements are merely decorative—and thus at least partially camouflaging the utilitarian nature or purpose of the engagement features by virtue of the above-mentioned pull-through effect—can be further enhanced by having at least portions of the non-engagement elements be larger in the generally horizontal and/or generally vertical dimension and/or in surface area than is characteristic of conventional engagement features, e.g. threads or lugs. The viewer is thus given, to an even greater extent, the impression that the non-engagement elements are decorative. For example, at least one non-engagement element may have a vertical dimension that is significantly greater than 2 mm, which is the distance across the face of a typical screw thread on a lidded vessel, and/or at least one non-engagement element in a cluster may have a surface area that is at least 1½ times as large as the surface area of any engagement feature in the same cluster.

The appearance (and reality) that the non-engagement elements are merely decorative—and thus at least partially camouflaging the utilitarian nature or purpose of the engagement features by virtue of the above-mentioned pull-through effect—can be further enhanced by the non-engagement elements having a thickness, or "crest," (i.e. dimension generally perpendicular to the vessel side wall) that is atypical for a lidded vessel's engagement features. More particularly, the maximum crest of one or more of the non-engagement elements may be less than the minimum crest of the engagement features. Thus while the crest of the typical engagement feature for a lidded vessel of the size of a drinking glass might be approximately 1 mm, the crest of one or more of the non-engagement elements of a particular embodiment can be less than that. In any event, the crest of the non-engagement elements should not be such as to interfere with the application and removal of the lid from the vessel. Any of the non-engagement elements (designated by N) in any of the disclosed embodiments could have a crest less than that of the engagement features.

Moreover, the crest of a non-engagement element can vary across the face of the non-engagement element and/or the crest of various non-engagement elements can vary among themselves. That is, the maximum crest of each of two or more of the non-engagement elements can differ from one another. A good example of an embodiment where this approach could be used to enhance the non-engagement elements' camouflaging effect is that of FIG. 38, where the leaves, grapes and twigs could be embossed at various heights from the sidewall—creating a sculptural effect that at least partially camouflages the utilitarian function of the engagement features to an even greater extent than those features are at least partially camouflaged by their own configurations, as noted more fully below.

The non-engagement element(s) can, indeed, have a diminishingly small crest, such as the non-engagement elements in FIGS. 41 and 42, which are in intaglio meaning that they are actually sunk below the outside surface of the bowl. Such intaglioed non-engagement elements may be formed in the inside or outside surface of the drinking vessel by being etched therein, for example, by a laser beam. Similarly, otherwise essentially flat non-engagement elements may be so formed. When the drinking vessel is formed in a mold, the mold may include an embossed version of the non-engagement element so that that non-engagement element appears in intaglio in the inside or outside surface of the bowl. Non-engagement elements as described in this paragraph may be above or below the outside surface or otherwise essentially flat and positioned behind, around, above, below, next to and/or on the engagement features. The camouflaging effect is particularly strong if the non-engagement element(s) overlay one or more of the engagement features.

Camouflaging the Engagement Features' Utilitarian Nature or Purpose Via Configuration(s) of the Engagement Features Themselves The utilitarian function of the engagement features can be at least partially camouflaged in particular embodiments by configuring the engagement features using one or more of the camouflaging techniques/configurations described hereinabove in connection with the non-engagement elements.

Thus the engagement features—designated in the various FIGS. as H (holding) and S (stopping)—and/or the elements that make up a given engagement feature may have one or more curved or arcuate, edges, as in at least FIGS. 3, 11, 12, 15, 25, 27, 30, 34-37, 39, 40 and 42; may be one or more radially or axially symmetric two- or three-dimensional geometrical shapes, such as a dot (FIG. 3), diamond (FIG. 29) or a star (FIGS. 34-35); may be an arbitrary, substantially non-linear or fanciful shape (FIGS. 11, 12, 15, 27, 39) or arbitrary may be all or a part of a representation of an everyday object, such as a leafed twig (FIG. 3), a leaf (FIG. 25), an animal (FIG. 30), piece of sports equipment (FIGS. 34-37). or a part of a grapevine (FIG. 38); or may be configured as, or as a part of, for example, an organizational logo, an alphanumeric character, a word or words that may convey a slogan or other textual message, such as in FIG. 40 where at least ones of the uppercase letters C, T, G and a second T serve as engagement features.

And thus the engagement features and/or the elements that make up a given engagement feature may be larger in the generally horizontal and/or generally vertical dimension and/or in surface area than is characteristic of conventional engagement features, e.g. threads or lugs and/or that would be required for an element or portion thereof to carry out its engagement function. This can reinforce the impression in the viewer's mind that the engagement features are not present for a functional or utilitarian purpose. For example, at least one engagement feature or element that is a part of an engagement feature, may have a vertical dimension that is significantly greater than 2 mm, which is the distance across the face of a typical screw thread on a lidded vessel. For example, that only a portion 108 of element 102—which provides the stopping function—is actually required to provide that function. The remainder of element 102 simply helps camouflage its utilitarian function. This is also an aspect of one or more elements in some of the embodiments of FIGS. 9-42 including, but not limited to, the left-most portion of the holding element in FIGS. 11, 14, 21, 25, and 29; the top-most portion of the holding elements in FIGS. 31 and 33; and the lower portion of the holding elements in FIGS. 9, 10, 12, 24, 38 to 42, as well as the "swan" element in FIG. 30.

Moreover, in particular embodiments implementing any of the aspects just mentioned, the utilitarian nature or purpose of the engagement features can be further at least partially camouflaged by configuring the engagement features in such a way that a given engagement function, such as the "holding" function is provided by two or more individual features, e.g. a broken line comprising two or more shapes as, for example, the holding feature H in FIGS. 10, 23 and 34-37.

Clustering and Arrangement of Elements within Clusters

The camouflaging of the utilitarian nature or purpose of the engagement features can also be further enhanced in a number of ways calculated to appeal to the viewer's aesthetic sense and to thus induce in the mind of the viewer that there was an aesthetic or artistic intent on the part of the vessel designer as to how the designer arranged the non-engagement and/or engagement elements of a cluster.

For example, the presence within a cluster of two or more spaced-apart elements induces in the mind of the viewer an aesthetic or artistic intent on the part of the vessel designer that belies the fact that one or more of those elements has a utilitarian function. This is evident in at least the embodiments of FIGS. 3, 10, 23, 29 and 34-37.

An aesthetic or artistic intent on the part of the designer—thereby belying the fact that one or more elements in the engagement feature band has a utilitarian function—is further induced in the mind of the viewer when at least two of the elements are geometrically different from one another, as in FIGS. 3, 29 and 34-37. (At least in this context, a multi-element cluster is a group of elements that is horizontally separated from adjacent rotated replicas of that cluster by a distance (designed ES in FIG. 3, as an example) that is greater than the largest horizontal separation between any two adjacent elements within a cluster. By this definition, then, no multi-element clusters are present in a situation, as may be known in the prior art, in which individual lugs are equally spaced in a line around the sidewall of a vessel.)

An aesthetic or artistic intent on the part of the designer—thereby belying the fact that one or more elements in the engagement feature band has a utilitarian function—is further induced in the mind of the viewer by virtue of the presence around the engagement feature band in particular embodiments of exact or nearly exact rotationally displaced replicas of the same multi-element cluster that, in particular embodiments, may be disposed symmetrically around the engagement feature band. Repetition and symmetry are regarded as important graphical design elements and their presence suggests an aesthetic or artistic intent that, again, belies the fact that some of the element(s) are there to provide a function. Indeed, the clusters in each given embodiment shown in FIGS. 2, 3, 7-37 are illustratively rotationally displaced replicas of the other clusters of the given embodiment and symmetrically disposed around the engagement feature band. In many of those embodiments there will be four or multiples-of-four clusters, so as to accommodate the four lugs 34 of lid 12, it being recognized, of course, that some other number of lugs, with corresponding engagement feature clusters, could be used.

An aesthetic or artistic intent on the part of the designer—thereby belying the fact that one or more elements in the engagement feature band has a utilitarian function—is further induced in the mind of the viewer when there is at least one element within the engagement feature band that shared by two or more of the clusters. Bead 202 in the embodiment of FIGS. 7-8 is such a shared element, as described above. The shared element may provide an engagement function, as in the case of bead 202 that provides the stopping function. In other embodiments, however, such a shared element may be a non-engagement element, such as the beads designated with an N in FIGS. 9, 17 (where the lower of the two circumferential beads is a non-engagement element), 13, 23, 30 and 42. (The circumferential bead's presence may, however, aid automated filling equipment when the vessel is sold as a pre-filled item.)

Downward Displacement of the Engagement Feature Band

The utilitarian nature or purpose of the engagement features can be further at least partially camouflaged by positioning the engagement feature band downwardly from the vessel rim so as to leave a clear space on the outside of the vessel. Each of the disclosed embodiments incorporates this aspect as well. Note the clear space CS on the surface of vessel 10 in the embodiment of FIG. 3. As to this aspect, it is noted that our co-pending U.S. patent application Ser. No. 13/240,194 discloses the idea that the engagement features of a pre-filled and sealed drinking vessel, such as a pre-filled and sealed wine glass, can be positioned downwardly from the vessel rim so as to leave a clear space on the outside of the vessel. We point out in that patent application that such positioning of the engagement features enhances the tactile aspect of user's drinking experience when drinking from a pre-filled vessel in that the user's lips encounter an unobstructed surface rather than the engagement features. Thus the user gets a very different drinking experience than is gotten from when one simply drinks "out of the bottle"—as happens when one drinks from a conventional screw-top soda bottle and one's mouth encounters the threads disposed at rim level. We have recognized that this positioning of the engagement features downward from the vessel rim not only enhances the user's tactile experience, as just noted, but also helps to at least partially camouflage their utilitarian nature or purpose from the visual perspective and thus enhances the consumer's overall drinking experience. People are so used to the idea that a container's engagement features are disposed right at the rim of the vessel that there will be a tendency for them to not perceive engagement features that are displaced away from the rim as being engagement features at all.

Dimensional Aspects

Some illustrative dimensional aspects of vessels embodying principles of the disclosure may be noted.

A vessel that is about the size of a drinking glass—such as those shown in the various FIGS, herein—may have a height of about 9 cm-30 cm. The vessel depicted in FIGS. 1-3, in particular, may have a height of about 17 cm. In order to hold a conventional screw lid on a vessel of about that size without the threads being "overlarge," the threads on the vessel would typically have a height of about 1 mm at the surface of the thread, and a height of about 2 mm at the surface of the vessel. By contrast, element 102 illustratively has a height of about at least 15 mm (1.5 cm). And as to surface area, only a portion of element 102—designated at 108—is actually required to provide the stopping function. The remainder of element 102—which may have about twice the surface area of portion 108—simply helps camouflage element 102's utilitarian function.

Because one of the goals with respect to particular embodiments is for the user to have a drinking experience that is similar or identical to the experience that is had when a beverage is drunk from a drinking glass or other drinking vessel into which the beverage has been poured, vessels having engagement features embodying principles of the disclosure may, in particular embodiments, have the size of a conventional drinking glass—namely a vessel with a drinking rim with a diameter approximately in the range of 3.5 cm to 9 cm and with a height of about 9 cm-30 cm.

As previously stated, the amount by which engagement and non-engagement elements protrude from the sidewall of the vessel is referred to herein as the "crest." The crest can be chosen based on functional and/or aesthetic considerations, taking into account such factors as the size and intended function of the vessel and the nature of the materials used for the vessel and/or the lid. For example, we envision that the crest for the engagement features of a drinking vessel will be about between 0.5 mm and 1.0 mm. However, the crest for consumer-use vessels of the type we more generally envision might be larger—up to perhaps about 2.5 cm.

For non-engagement elements, the crest dimension can vary, even on a given element, such as the grapes in the embodiment of FIG. 38. The crest of certain non-engagement elements may be the same as for engagement features, while other non-engagement elements could be embossed and not extend out as far as the engagement features. The varying crest of non-engagement elements allows for greater camouflaging of the engagement features while not interfering with the engagement function.

The distance across an engagement feature element in the vertical or generally vertical direction is referred to herein as the element "height." In the case of thin elements disposed at an angle to the horizontal, e.g. elements that are screw-thread-like, the "height" is the distance across the element in a direction perpendicular to the long axis. By way of example, the element height is designated as "h" in FIG. 8. The "height" of the typical screw thread in the prior art is about 0.5 mm and we envision that the elements of our engagement features will have at least that height. However, as can be seen from the embodiments, elements of our engagement features can have heights much in excess of 0.5 mm. For example, in the embodiment of FIG. 30, where the vessel 10 may have a height of about 20 cm, the "swan" element may have a height of perhaps 20 mm.

The further away from the rim the engagement features are located, the less they will be perceived by the viewer as being strictly utilitarian or functional. On the other hand, that distance will dictate the conformation of the lid since it has to engage the engagement features and thus should not be so far down from the rim as to dictate the need for a lid that extends further down the side of the vessel than might be functional and/or attractive. With the above in mind, a desirable distance between the engagement features and the rim is between 10 mm and 40 mm for embodiments where the engagement features are used on a drinking glass. An advantageous balance between/among the above factors is achieved when that distance is approximately 15 mm.

We envision the engagement feature band to have a height in typical embodiments of between 3 mm and 30 mm.

Manufacturability

We have recognized the desirability of conforming to standard "cylinder" sizes and/or standard volumes based on manufacturability concerns.

The prior art does know of the idea of vending beverages in sealed containers wherein the sealed containers are or at least appear to be conventional drinking glasses.

There is nothing inherent in the notion of manufacturing and selling pre-filled and sealed beverage containers that requires that the containers have any particular dimensions and/or volume.

But we have come to recognize that in order to be readily and economically manufactured on a large scale for mass markets, pre-filled/resealable drinking glasses need to be sized and/or dimensioned taking into account the realities of modern assembly line beverage filling.

In particular, we have come to realize that it is highly desirable that, filled-and-sealed beverage vessels of the type envisioned by us, they conform to standard diameters "cylinders" and/or standard beverage amounts, so that they can be filled, sealed and put into cartons by manufacturing equipment that is the same as, or very similar to equipment, already in use in the industry for cans bottles and jars. Just to take one example, bottles and cans are moved along certain portions of assembly lines in "single file" between sets of guide rails that are spaced apart from one another by a distance that is appropriate for one of the standard diameters. It might well not be economically feasible for the manufacturers of such assembly line equipment to design and manufacture equipment that has some other "custom" spacing because of the relatively small demand that there would be for such customization. It could take a couple of calendar days and many man hours to set the guide rails for custom filling. Moreover, when the guide rails are reset back, if anything is off it could seriously disrupt the high volume production on that filling line.

"Cylinder" in this context means a theoretical cylinder into which a vessel to be filled would fit exactly at its widest width and height. Note that if the vessel were to have one or more handles, the "widest width" would take the handles into account. We envision that horizontal cross-sections of our pre-filled/resealable drinking glasses might not be circular in which case, again, the largest cross section will define the vessel's cylinder.

That is, the cylinder is defined as the diameter of the target container extending up to the height of the filling head. The replacement container may be of a different height than the container it replaces but have the same amount of contents if desired, or different volume if that is desired, especially since it is relatively uncomplicated to adjust the height of the filling head in existing bottle filling equipment. When it is desired for glassware as disclosed herein to be filled on filling lines that are set up to fill cans, it is desirable for the glassware height to match standard can heights as closely as possible.

The bottles and cans sold in the mass market conform to only a few such "cylinders," the most common of which have diameters of 6.6 cm and 7.3 cm and heights of 15 cm, 18.5 cm, and 19.5 cm.

The industry's "standard beverage amounts" are 187, 375, 500 and 750 ml, and 1.5 liters for wine and, for beer and soft drinks they are 8, 12, 16, 24, and 32 fl oz.

Our recognitions as just described contrast with the apparent marketing approach of those already in the market of manufacturing pre-filled/pre-sealed drinking glasses. Those manufacturers seem to be largely focused on the aesthetics of the containers and seem to be focused on niche markets and high-end beverages. As such, the manufacturing at low-cost and high-volume seems not to have been a concern. And thus our recognition that it would be advantageous for pre-filled/resealable drinking glasses to conform to the standard cylinders used in the bottling industry is not something that has been previously recognized in the art.

Advantageously, a bottler may have an existing manufacturing line that it uses for prior art types of vessels but the bottler would like to be able to produce pre-filled/resealable drinking glasses as described in this disclosure and our pending patent applications. Conforming the pre-filled/resealable drinking glasses to standard cylinders can allow the bottler to do that without having to dramatically alter the equipment on the line.

Other Manufacturability Recognitions

We have recognized the desirability of pre-filled/resealable drinking glasses having certain other characteristics in order to allow for economical and practical manufacture of same in large quantities for mass markets.

Jamming of the items on the filling lines is a potential concern. We have recognized that the possibility of jamming of pre-filled/resealable drinking glasses is reduced by configuring the vessels so as to have a relatively a low center of gravity. Specifically, we envision that the center of gravity should be such that the drinking glass has a tip angle of at least about 13 degrees, meaning that if the glass is tipped more than about 13 degrees from vertical, it will fall over but if tipped less than that, it will right itself.

In order to minimize the possibility of breakage on the assembly line, we have recognized that the vessel walls should be sufficiently thick at and near where the vessels will touch each other when standing side-by-side that the inevitable jostling that occurs on the line will not, with only rare exception, result in the vessels getting broken if they are made of something frangible like glass. Specifically, when the vessel is made of glass, that thickness is desirably around 2.25 mm. Other parts of the vessel would not have to be as thick.

In order to minimize the possibility of the vessels tipping as they travel along the line, the widest point of the base of the vessel would be the same diameter of the widest part of the lid.

We have further recognized that another potential problem is that vessels that have a pedestal base, such as stemware, might tend to slip onto the pedestal base of the vessel next to it on the assembly line, and we have recognized that this can be largely avoided if the rim of the pedestal base is of a height that is greater than the minimum height that one might otherwise choose if one were concerned only about aesthetics. In particular, this tendency will be largely overcome if the rim of the pedestal base is at least 3 mm high.

The vessel needs to be of sufficient structural strength that it can withstand the downward pressure of the filling head.

Colored Glass

If desired, the vessel, e.g. a glass vessel, can be colored with a color that is different from the color of the beverage that is sealed into the vessel. As a result an entertaining effect is achieved in that the glass will appear to change color as more and more of the beverage is drunk. For example, a vessel made of a red-tinted glass filled with a yellow beverage will appear to be green, but the glass would seem to "change" from green to red as the yellow contents are drunk. Having the three sections of the glass—base, stem and bowl—all being liquid-containing, as discussed below would make this effect all the more interesting.

Hollow Base And Stem

We have further recognized that the cost of manufacturing stemmed glass vessels that can be used, for example, as pre-filled/resealable drinking glasses can be kept low if the vessel is produced as one whole piece using the technology that is used to make bottles, for example. Such a stemmed glass will have both the stems and pedestals (bases) hollow so that liquid poured into the glass will enter the base, then enter the stem and then the bowl. The cost will be less because fewer steps will be involved in the manufacturing process.

Another benefit is that such a glass will not have a weak point where the stem meets the bowl, which is a potential problem for prior art stemware which is manufactured with the stem being a separate piece that is attached to the drinking bowl by sonic welding, spin welding, or reheating the surfaces and melting them together.

If desired, the drinking glass may have a plug inserted at the bottom of the drinking bowl to contain liquid therein. Alternatively, the drinking glass may be configured in such a way that liquid can flow into stem (if there is a stem) and/or the base.

The drinking glass may thus be characterized in one aspect as an apparatus comprising: a drinking bowl; and a hollow base connected to the drinking bowl wherein the contents in the drinking bowl can flow into a chamber enclosed by the hollow base.

The drinking glass may be characterized in another aspect as an apparatus comprising: a drinking bowl; and a hollow base constructed in fluid communication with said drinking bowl, where by "fluid communication" is meant that the beverage or other liquid contained by the apparatus can flow freely from one part of the apparatus to the other.

The drinking glass may be characterized in another aspect as an apparatus comprising: a drinking bowl; and a hollow stem connecting said drinking bowl to a hollow base, wherein the contents in the drinking bowl can flow through the hollow stem into the chamber enclosed by the hollow base. The stem may have any desired length, including a length that is, for example, similar to the height of the bowl or the stem may be quite truncated The drinking glass may be made of plastic or glass.

The bowl, the base and the stem (if the drinking glass has a stem) may each be clear, colored, frosted or opaque, yielding 16 possible combinations for a drinking glass with just a bowl and a base and 64 possible combinations if the drinking glass also has a stem.

The drinking glass may be formed in one continuous piece manufactured by means substantially similar to Injection Stretch Blow Molding or by means substantially similar to Extrusion Blow Molding. Or it may be manufactured as multiple pieces and assembled into one unit.

Variations

The foregoing merely illustrates principles of the disclosure and many variations are possible.

For example, there are certainly virtually endless alternative shapes for the engagement features. Flexible or rigid materials can be used to fabricate the vessel and/or its lid. A plurality of different styles or shapes of lids or covers might engage with the same set of vessel engagement features, the choice being made based on, for example, different functional or aesthetic reasons.

Vessels having engagement features embodying principles of the disclosure may have any of a variety of wall shapes, including straight wall, flared, convex or concave. For most of the embodiments disclosed herein, the engagement feature band is on a portion of the vessel wall that is convex or straight.

Moreover, principles of the disclosure are not limited to drinking vessels. The idea of at least partially camouflaging the engagement features of a sealable vessel—whether sold pre-filled or not—can be applied to a wide variety of containers that, once unlidded, would perceived to be, for example, a carafe or a serving vessel of some kind, rather than a utilitarian container. Thus, for example, a supermarket-purchased jar of food provided with engagement features pursuant to the disclosure could be used as an attractive pantry-to-table or fridge-to-table serving piece upon the lid being removed. Other possibilities include a ceramic canister, a travel mug or a thermos bottle.

Nor are principles of the disclosure limited to vessels intended to hold foodstuffs, for example, a planter having engagement features embodying principles of the disclosure might be sold pre-filled with soil. Other possibilities include a cosmetics container or cream jar. In fact, principles of the disclosure are not limited to items which are typically thought of as "containers", and can be used for objects that need to have a "cover" secured by some kind of attachment mechanism.

It will thus be appreciated that those skilled in the art will be able to devise numerous arrangements which, although not shown or described herein, embody principles of the invention and are thus within its spirit and scope.

What is claimed is:

1. A vessel comprising:

a bowl for holding a product, the bowl having a rim defining an opening, the bowl having a bottom, and the bowl having protrusions on an outside surface of the bowl within an engagement feature band on said outside surface of the bowl;

a lid rotated onto the bowl and covering the opening, the lid having one or more lid engagement features engaged with one or more bowl engagement features configured to seal the product in the bowl, each of the one or more bowl engagement features being at least a portion of at least one of the protrusions within said engagement feature band, each of the one or more bowl engagement features having at least one of three engagement functions, said three engagement functions being a) engaging with said lid engagement features to hold the lid on the bowl, b) guiding the lid engagement features into positions where the lid engagement features engage with one or more of said bowl engagement features when the lid is rotated onto the bowl, and c) stopping the lid from being rotated onto the bowl to such an extent that said lid engagement features disengage from said one or more bowl engagement features; and at least one non-engagement element that is in intaglio in a surface of the vessel, or is flat on the surface of the vessel, at least a portion of said at least one non-engagement element being closer to the rim of the bowl than at least a portion of at least one of the bowl engagement features.

2. The vessel of claim 1 wherein the vessel is an article that was formed, at least in part, in a mold that included an embossed version of the at least one non-engagement element so that the at least one non-engagement element was caused to appear in intaglio in a surface of the vessel.

3. The vessel of claim 1 wherein the at least one non-engagement element is sunk below the surface level of the vessel.

4. The vessel of claim 1 wherein the at least one non-engagement element includes a depiction of grapes and/or grapevines.

5. The vessel of claim 1 wherein the at least one non-engagement element is all or part of an organizational logo.

6. The vessel of claim 1 wherein the at least one non-engagement element is an alphanumeric character, a word, a part of a word, or presents a multiword textual message.

7. The vessel of claim 1 wherein the at least one non-engagement element is disposed behind at least one of the bowl engagement features.

8. The vessel of claim 1 wherein the at least one non-engagement element is disposed around at least a portion of at least one of the bowl engagement features.

9. The vessel of claim 1 wherein the at least one non-engagement element is disposed above and/or below at least a portion of at least one of the bowl engagement features.

10. The vessel of claim 1 wherein the at least one non-engagement element is disposed next to at least a portion of at least one of the bowl engagement features.

11. The vessel of claim 1 wherein the at least one non-engagement element overlays at least a portion of at least one of the bowl engagement features.

12. A vessel comprising:

a bowl for holding a product, the bowl having a rim defining an opening, the bowl having a bottom, and the bowl having protrusions on an outside surface of the bowl within an engagement feature band on the outside surface of the bowl;

one or more bowl engagement features, each of the one or more bowl engagement features being at least a portion of at least one of the protrusions within the engagement feature band and being adapted for mating with a lid, wherein the lid is adapted to be rotated onto the bowl so as to cover the opening, the lid having one or more lid engagement features to engage with the one or more bowl engagement features to seal the bowl, each of the one or more bowl engagement features having at least one of three engagement functions, the three engagement functions being a) to engage with the lid engagement features to hold the lid on the bowl, b) to guide the lid engagement features into positions where the lid engagement features engage with one or more of the bowl engagement features when the lid is rotated onto the bowl, and c) to stop the lid from being rotated onto the bowl to such an extent that the lid engagement features disengage from the one or more bowl engagement features; and at least one non-engagement element that is in intaglio in a surface of the vessel, or is flat on the surface of the vessel, at least a portion of said at least one non-engagement element being closer to the rim of the bowl than at least a portion of at least one of the bowl engagement features.

13. The vessel of claim 12 wherein the vessel is an article that was formed, at least in part, in a mold that included an embossed version of the at least one non-engagement element so that the at least one non-engagement element was caused to appear in intaglio in a surface of the vessel.

14. The vessel of claim 12 wherein the at least one non-engagement element is sunk below the surface level of the vessel.

15. The vessel of claim 12 wherein the at least one non-engagement element includes a depiction of grapes and/or grapevines.

16. The vessel of claim 12 wherein the at least one non-engagement element is all or part of an organizational logo.

17. The vessel of claim 12 wherein the at least one non-engagement element is an alphanumeric character, a word, a part of a word, or presents a multiword textual message.

18. The vessel of claim 12 wherein the at least one non-engagement element is disposed behind at least a portion of at least one of the bowl engagement features.

19. The vessel of claim 12 wherein the at least one non-engagement element is disposed around at least a portion of at least one of the bowl engagement features.

20. The vessel of claim 12 wherein the at least one non-engagement element is disposed above and/or below at least a portion of at least one of the bowl engagement features.

21. The vessel of claim 12 wherein the at least one non-engagement element is disposed next to at least a portion of at least one of the bowl engagement features.

22. The vessel of claim 12 wherein the at least one non-engagement element overlays at least a portion of at least one of the bowl engagement features.

23. The vessel of claim 1 wherein the at least one non-engagement element is etched into the outer surface through the molding process or imparted onto the outer surface by a secondary process after the vessel is made.

24. The vessel of claim 12 wherein the at least one non-engagement element is etched into the outer surface through the molding process or imparted onto the outer surface by a secondary process after the vessel is made.

25. The vessel of claim 1 wherein the at least one flat non-engagement element is imparted by a secondary process after the vessel is made.

26. The vessel of claim 12 wherein the at least one flat non-engagement element is imparted by a secondary process after the vessel is made.

* * * * *